United States Patent [19]

Wiethoff et al.

[11] Patent Number: 4,860,633

[45] Date of Patent: Aug. 29, 1989

[54] AUTOLOADER FOR MILITARY VEHICLE

[75] Inventors: Roger H. Wiethoff, Minnetonka; Gary J. Nelson, Buffalo, both of Minn.

[73] Assignee: FMC Corporation, Chicago, Ill.

[21] Appl. No.: 46,741

[22] Filed: May 7, 1987

Related U.S. Application Data

[62] Division of Ser. No. 784,921, Oct. 4, 1985, Pat. No. 4,700,609.

[51] Int. Cl.[4] ..... F41F 9/04

[52] U.S. Cl. ..... 89/45; 89/33.05; 89/33.02

[58] Field of Search ..... 89/33.05, 33.03, 33.02, 89/36.13, 45, 46, 47

[56] References Cited

U.S. PATENT DOCUMENTS

| | | | |
|---|---|---|---|
| 1,422,678 | 7/1922 | Dawson et al. . | |
| 2,592,790 | 4/1952 | Brereton . | |
| 2,788,713 | 4/1957 | Even . | |
| 2,789,472 | 4/1957 | Warlick | 89/4 |
| 2,933,981 | 4/1960 | Anderson et al. | 89/1.7 |
| 3,218,930 | 11/1965 | Girouard et al. | 89/45 |
| 3,228,293 | 1/1966 | Kane et al. | 89/1.7 |
| 3,241,447 | 3/1966 | Christiansson | 89/47 |
| 3,288,029 | 11/1966 | Birath | 89/33 |
| 3,501,996 | 3/1970 | Lipp et al. | 89/34 |
| 3,818,794 | 6/1974 | Mayer et al. | 89/45 |
| 4,088,058 | 5/1978 | Flemming et al. | 89/36 |
| 4,313,363 | 2/1982 | Schreckenberg | 89/46 |
| 4,391,179 | 7/1983 | Tidstrom | 89/46 |
| 4,481,862 | 11/1984 | Wiethoff et al. | 89/46 |
| 4,495,853 | 1/1985 | Gottwaldt | 89/46 |
| 4,632,011 | 12/1986 | Metz et al. | 89/36.13 |
| 4,640,182 | 2/1987 | DeHaven et al. | 89/47 |

FOREIGN PATENT DOCUMENTS

| | | | |
|---|---|---|---|
| 2257679 | 5/1974 | Fed. Rep. of Germany . | |
| 2433568 | 1/1976 | Fed. Rep. of Germany . | |
| 966693 | 10/1950 | France | 89/46 |
| 2467379 | 4/1981 | France | 89/47 |
| 2481793 | 11/1981 | France . | |
| 2519132 | 7/1983 | France . | |
| 179947 | 7/1962 | Sweden | 89/46 |

*Primary Examiner*—Charles T. Jordan
*Assistant Examiner*—Stephen Johnson
*Attorney, Agent, or Firm*—A. J. Moore; H. M. Stanley; R. B. Megley

[57] ABSTRACT

An autoloading method and apparatus is disclosed for a turret mounted gun that is pivoted horizontally relative to the turret and must be lowered to a substantially horizontal 0° position for loading selected cartridges from a magazine conveyor, ejecting empty cartridge cases and misfired cartridges from the gun and turret, assisting in replenishing cartridges from outside the turret into the magazine, and off-loading cartridges from the magazine. A partition divides the turret into two compartments with a gunner and a commander located in one compartment and the mechanical components of the autoloader and breech of the gun located in the other compartment. When the gun is returned to the 0° position for ejecting an empty case, the site of the director system remains on target. The turret is preferably mounted on a military land vehicle.

5 Claims, 21 Drawing Sheets

FIG_19
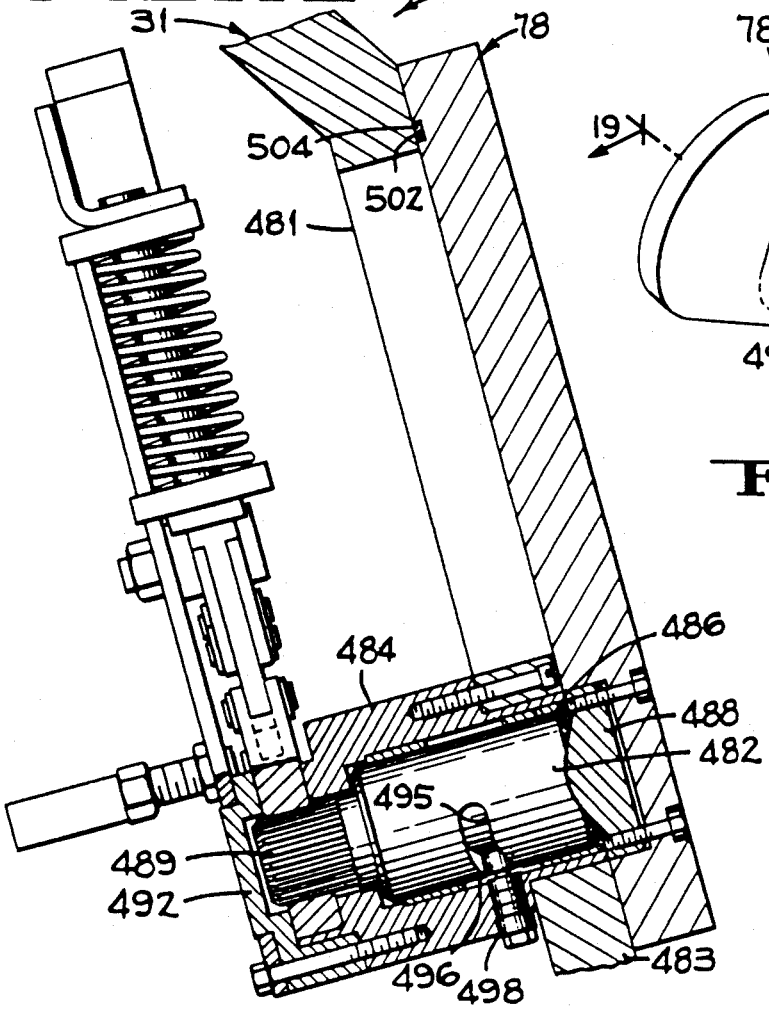
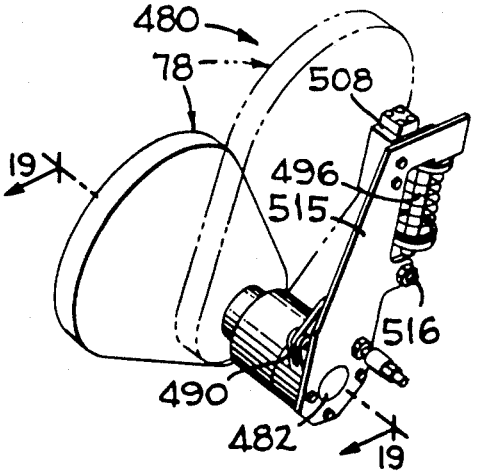
FIG_18
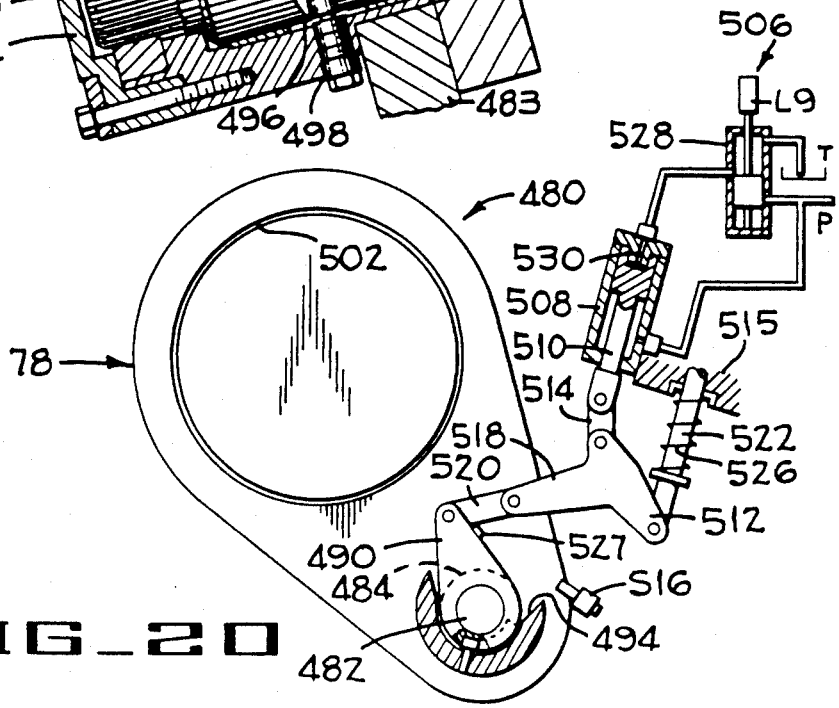
FIG_20

UNLOAD TIME CYCLE

REPLENISH TIME CYCLE

AUTOLOADER FOR MILITARY VEHICLE

This is a division of application Ser. No. 784,921, filed Oct. 4, 1985, now U.S. Pat. No. 4,700,609 which issued on Oct. 20, 1987.

BACKGROUND OF THE INVENTION

1. Field of the Invention

The present invention relates to an automatic ammunition loading system for a turret mounted gun which selectively loads desired cartridges from a magazine into the gun chamber; ejects empty cases after firing outside the turret; unloads unfired cartridges from the gun back into the magazine through a cartridge load-unload port, assists in replenishing cartridges into the magazine from outside the gun, offloads cartridges from a magazine and ejects misfires from the gun through an eject-reload port.

2. Description of the Prior Art

Large caliber guns mounted on a turret are well known in the art and their systems for control of the elevation and azimuth of the gun are old in the art, being disclosed in Girauard et al U.S. Pat. No. 3,218,930, and Assignee's Wiethoff et al U.S. Pat. No. 4,481,862 which issued on Nov. 13, 1984.

SUMMARY OF THE INVENTION

The present invention relates to an automatic loading system, or autoloader, for a turret mounted gun supported on an armored military vehicle, preferably a track or wheeled vehicle. The turret supports a gun, preferably a 105 millimeter gun, is adjustable in elevation and in azimuth and may be operated while the vehicle is stationary or is being driven in combat. The turret supports a kidney shaped magazine having an endless chain therein which may be driven in either direction and supports a plurality, preferably 19 rounds of various types for selective delivery to the cartridge load-unload port. An air tight partition in the turret separates the gun and autoloader components from a gunner and commander seated in the turret in position to easily observe the target being attacked and also observing the surrounding areas, either visually or by instrumentation. The vehicle driver may replenish the rounds in the magazine while being protected by the vehicle's armor from rounds stored in the vehicle, or the magazine may be replenished with rounds from outside the vehicle. The gun returns to a fixed generally horizontal position, herein referred to as the 0° position, for case ejection and reload although the sight of the director system remains on target. The autoloader system permits the gun to be fired at the rate of one round every five seconds. The autoloader loads rounds from the magazine into the gun, extracts and ejects the empty case externally of the vehicle; unloads unfired rounds and returns the rounds to the magazine; assists in replenishing rounds into the magazine from outside the vehicle; offloads rounds from the magazine; and ejects misfired rounds through the eject-reload port.

BRIEF DESCRIPTION OF THE DRAWINGS

FIG. 17A is an end view of the breech block shaft with a pair of magnets thereon which cooperate with a pair of switches to indicate whether the breech block is closed or open FIG. 17B is an end view of the breech block shaft illustrating a manually operated handle for manually operating the breech block.

FIG. 18 is a perspective of the reload-reject hatch assembly removed from the turret FIG. 19 is a section taken along lines 19—19 of FIG. 18 illustrating the reload-reject hatch assembly.

FIG. 20 is a diagrammatic operational view of the reload-reject hatch assembly FIGS. 21A and 21B together illustrate the hydraulic circuit including all of the several above described component circuits in a single diagram

DESCRIPTION OF THE PREFERRED EMBODIMENT

Figure 1:
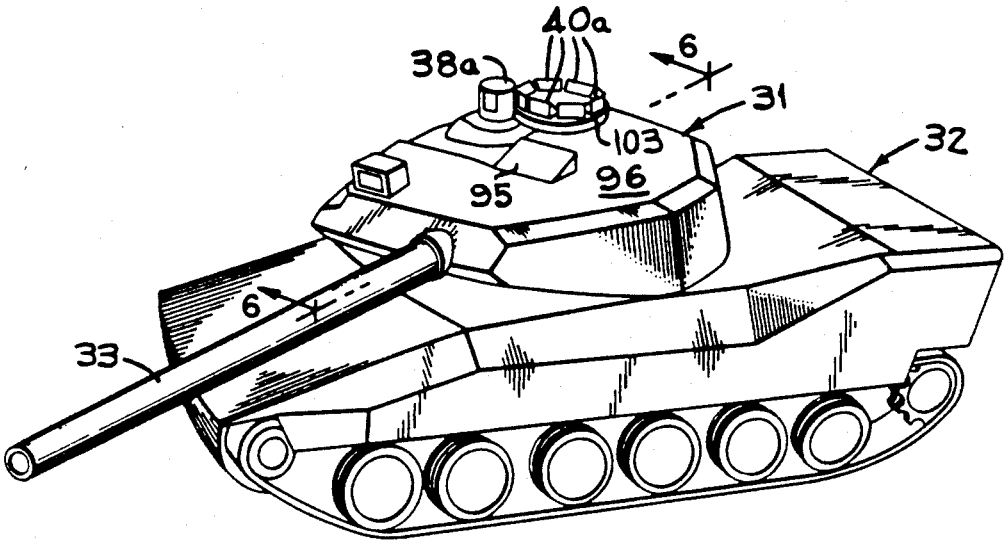
FIG. 1 is a perspective of a tracked military vehicle having a turret supporting gun and the autoloader of the present invention incorporated therein.

The automatic ammunition loader or autoloader 30 (FIG. 2) of the present invention is preferably mounted in an armored turret 31 (FIG. 1) supported on a self propelled military tracked vehicle 32 which includes a gun 33 which may be pivoted vertically relative to the turret 31.

Figure 4:
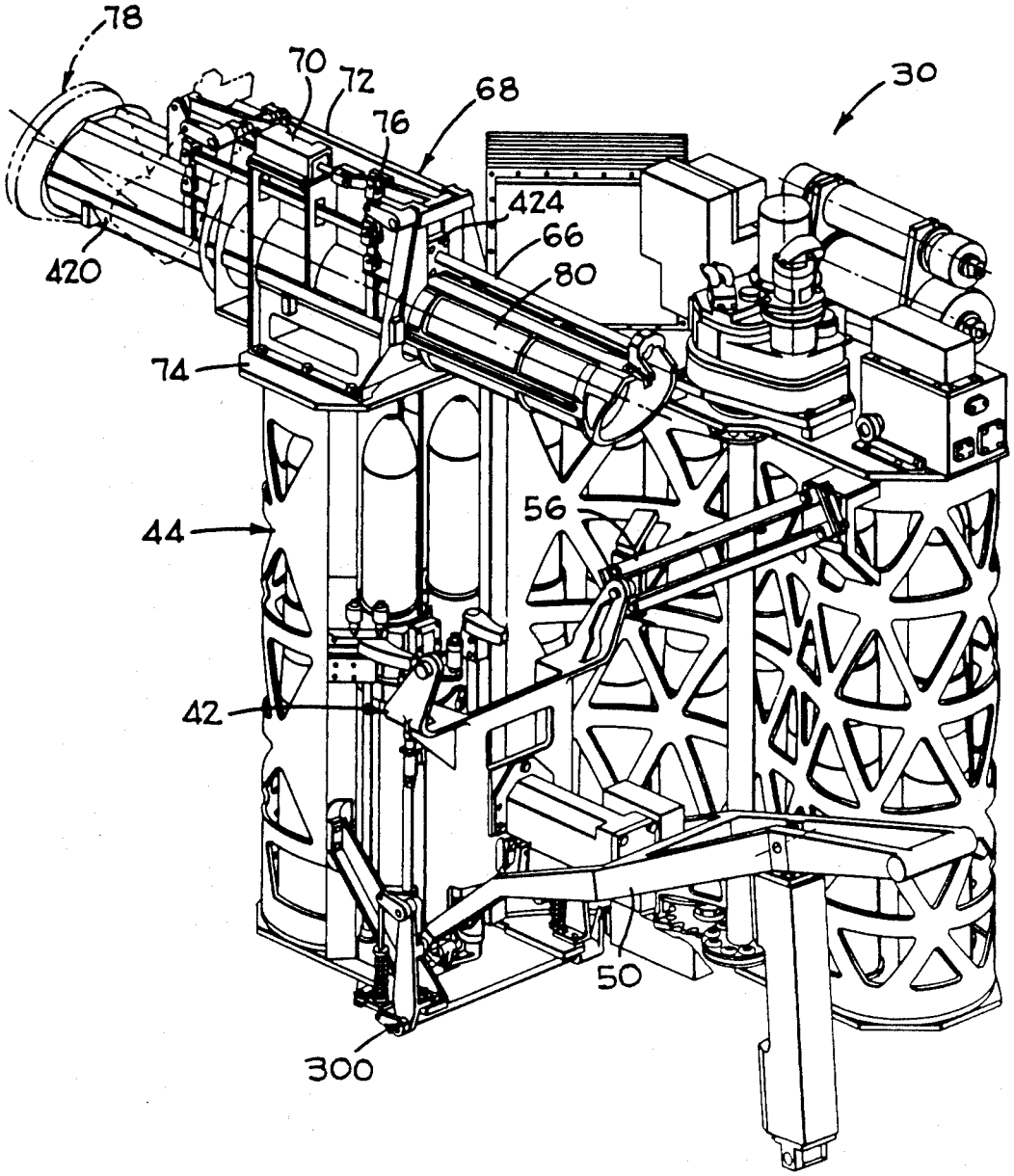
FIG. 4 is a perspective similar to FIG. 2 illustrating the load tray returned to a position adjacent the magazine load-unload station, and illustrating an empty case tray and rammer assembly extended to receive an empty casing or misfired cartridge from the gun for discharge from the turret externally of the vehicle, the reload-eject hatch being shown in a closed position.
Figure 5:
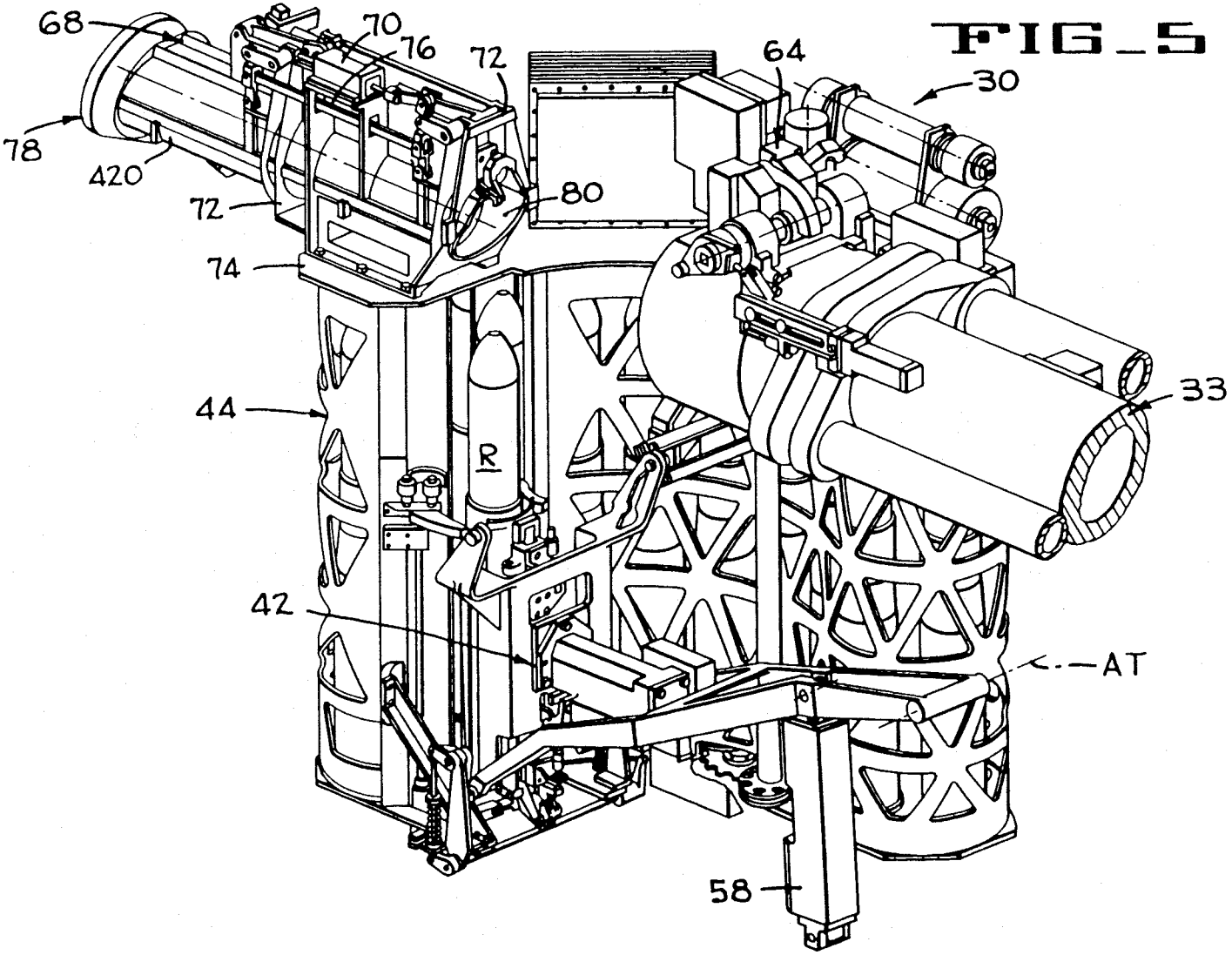
FIG. 5 is a perspective similar to FIG. 2 but at a smaller scale illustrating the gun locked in its 0° position with its breach block open to receive the round.
Figure 6:
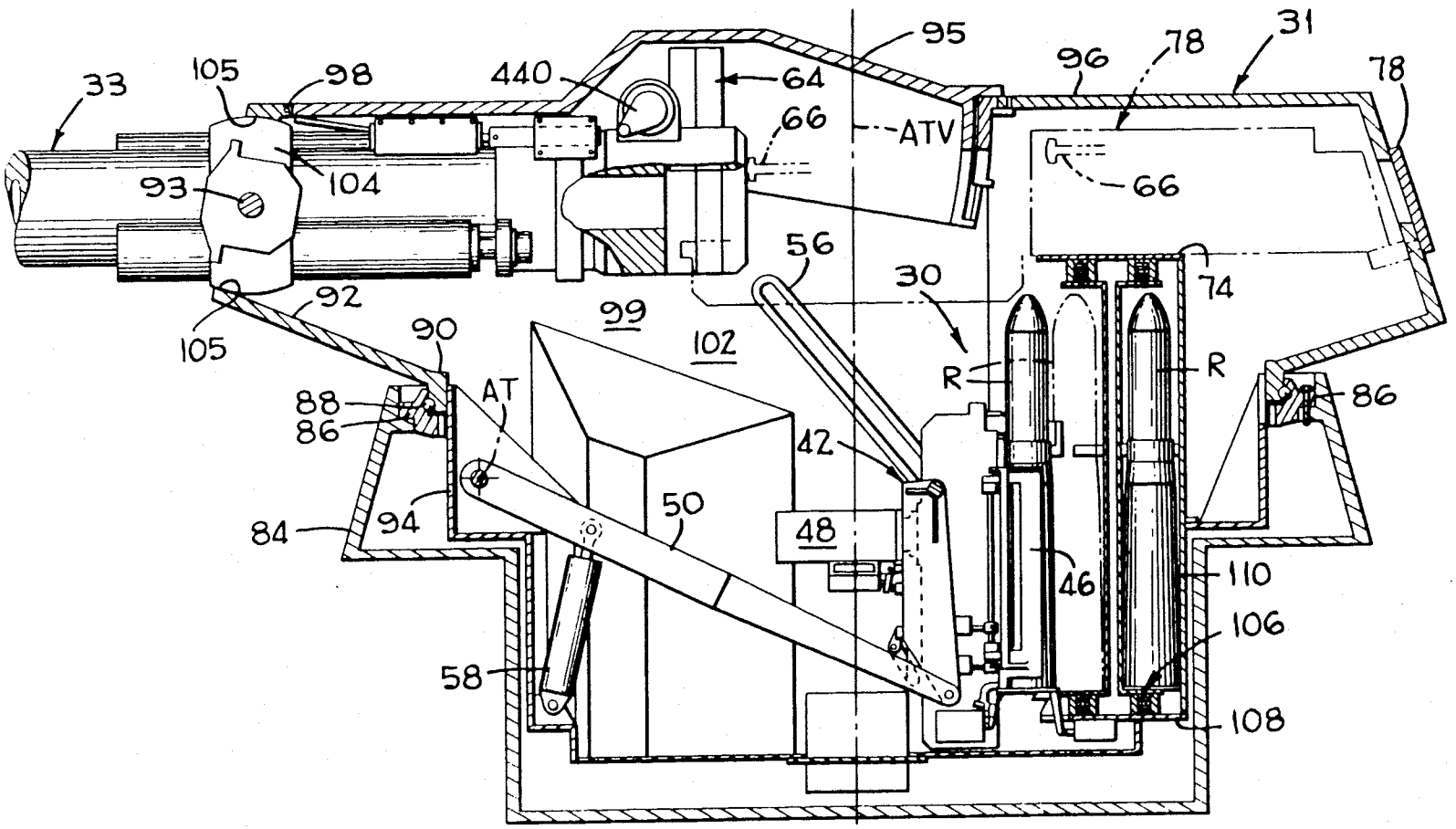
FIG. 6 is a vertical section taken along lines 6—6 of FIG. 1 taken through the turret with the load tray being shown in its lowered position adjacent the magazine with a round gripped therein, the position of the round removed from the magazine being shown in phantom line, certain parts of the gun being cut away.
Figure 7:
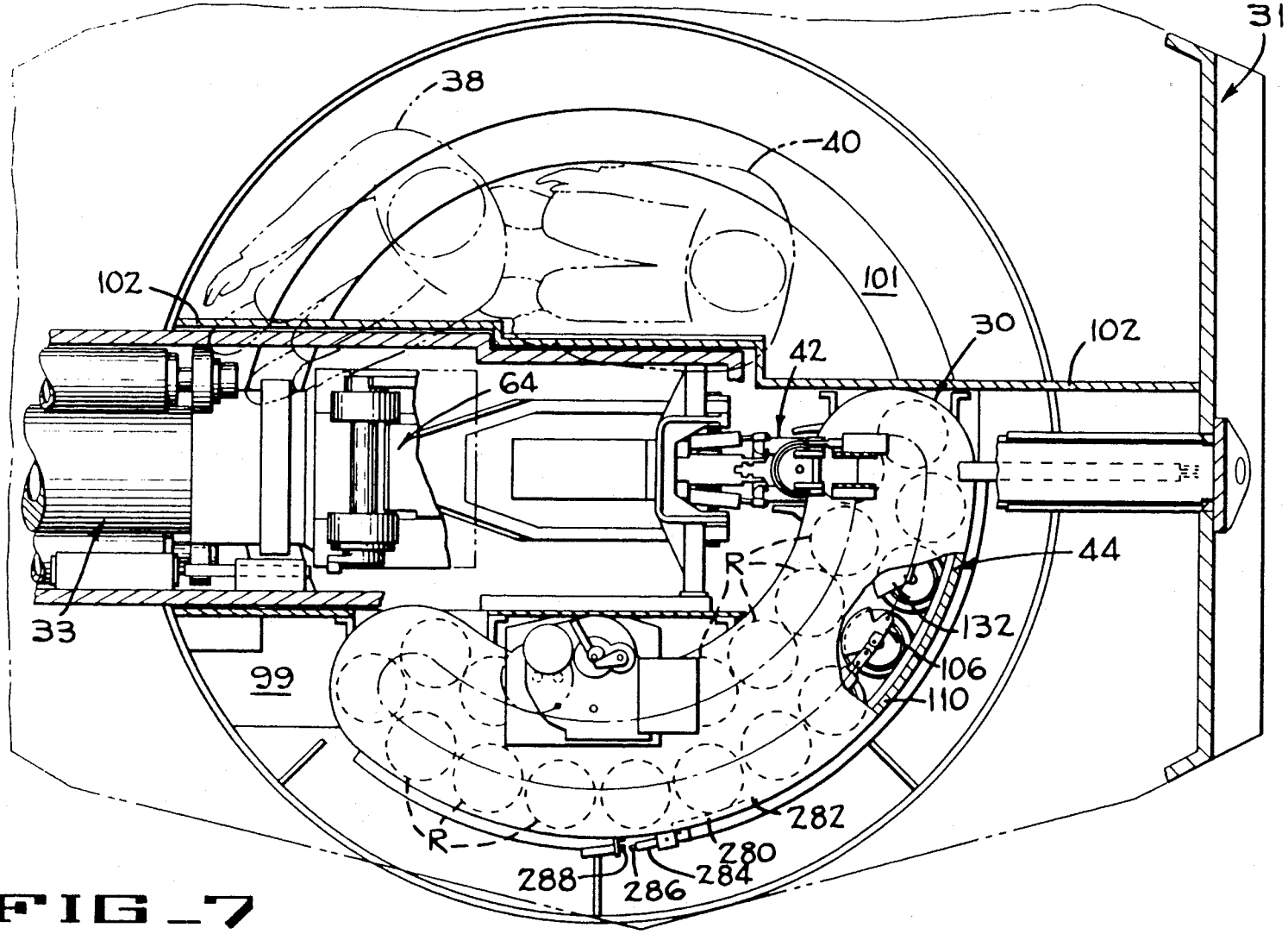
FIG. 7 is a horizontal section through the turret taken along lines 7—7 of FIG. 6 illustrating the position of the air tight partition separating the gunner and commander from the gun and the autoloader, certain parts being cut away.

Since the several components of the autoloader 30 are confined within the armored turret 31, it is believed desirable for better understanding of the autoloader to first broadly describe the several major components of the autoloader and their broad functions with the turret 31 and gun 33 removed as shown in FIGS. 2–5, and to thereafter describe the several components and their functions in more detail The turret 31 and the positions of a gunner 38, a commander 40 and the autoloader 30 within the turret 31 will then be described having reference to FIGS. 6 and 7; followed by a description of the several components and their functions aided by diagrammatic drawings which include hydraulic circuitry.

Figure 2:
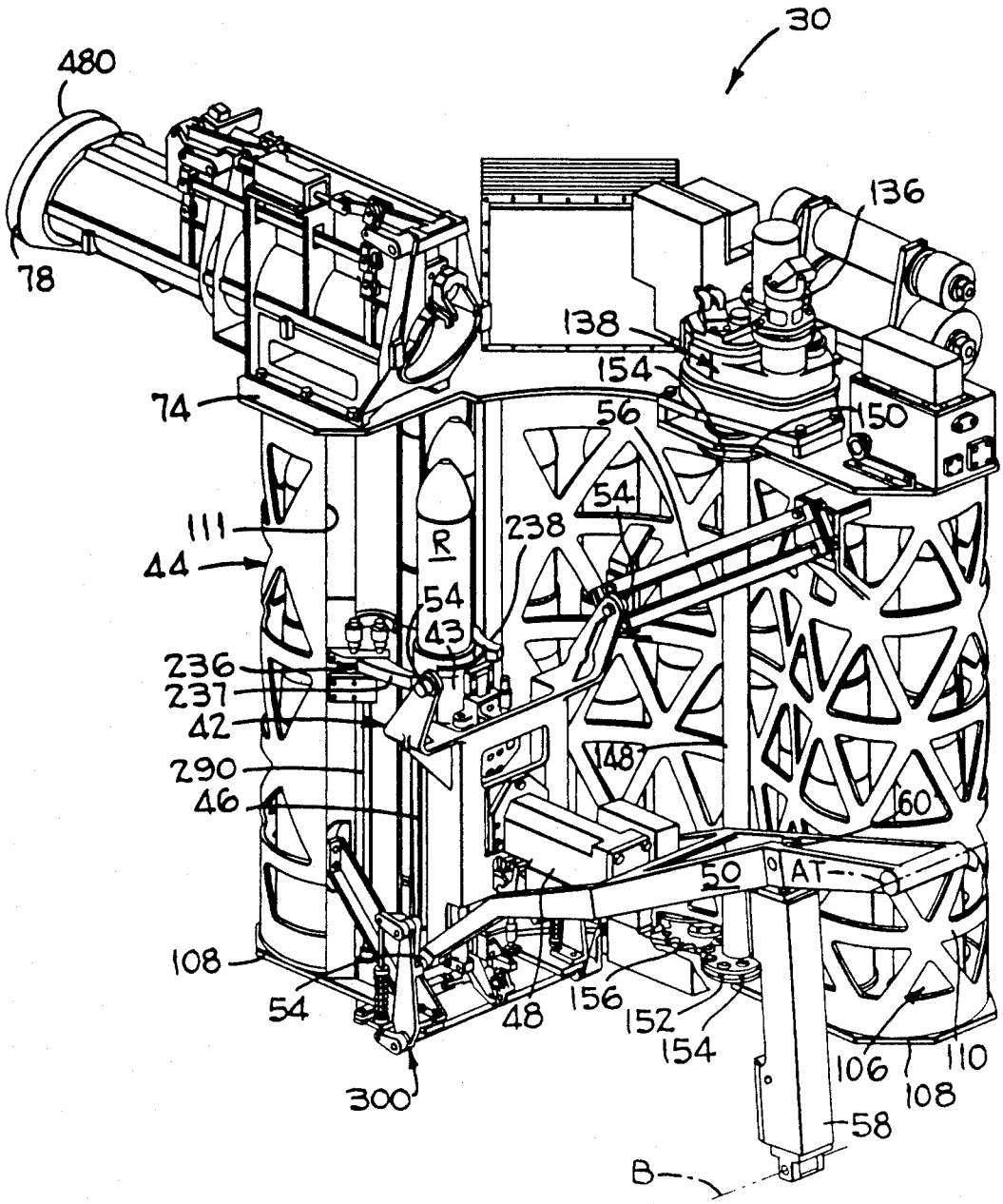
FIG. 2 is a perspective of the autoloader illustrating a round being withdrawn from the magazine at the magazine load-unload station by a load tray assembly and further illustrating an empty case eject tray in retracted position, and a reload-eject hatch assembly in closed position; the turret, gun and supporting vehicle being omitted.

As illustrated in FIGS. 2 and 4, a load tray support 42 is shown in its lowered retracted position after its load tray 43 has been translated into and out of a kidney shaped magazine 44 with the desired round R clamped thereto by pivotal cartridge clamps or clamp arms 46 (only one being shown) A load tray translating cylinder 48 has its case secured to the load tray support 42 and its rod (not secured to the load tray 43. A generally Y-shaped pivot arm 50 is pivotally connected to the turret 31 (FIGS. 6 and 7) for pivotal movement about an axis AT, and has its opposite ends pivoted to the load tray support 42 (FIG. 2). The load tray support includes a pair of rollers 54 with each roller received within an inclined track 56 (only one being shown) each being rigidly secured directly or indirectly to the turret 34. A tray pivoting cylinder 58 has its rod 60 pivotally connected to the Y-shaped arm 50 and its case pivoted to the turret 34 about axis B.

Figure 3:
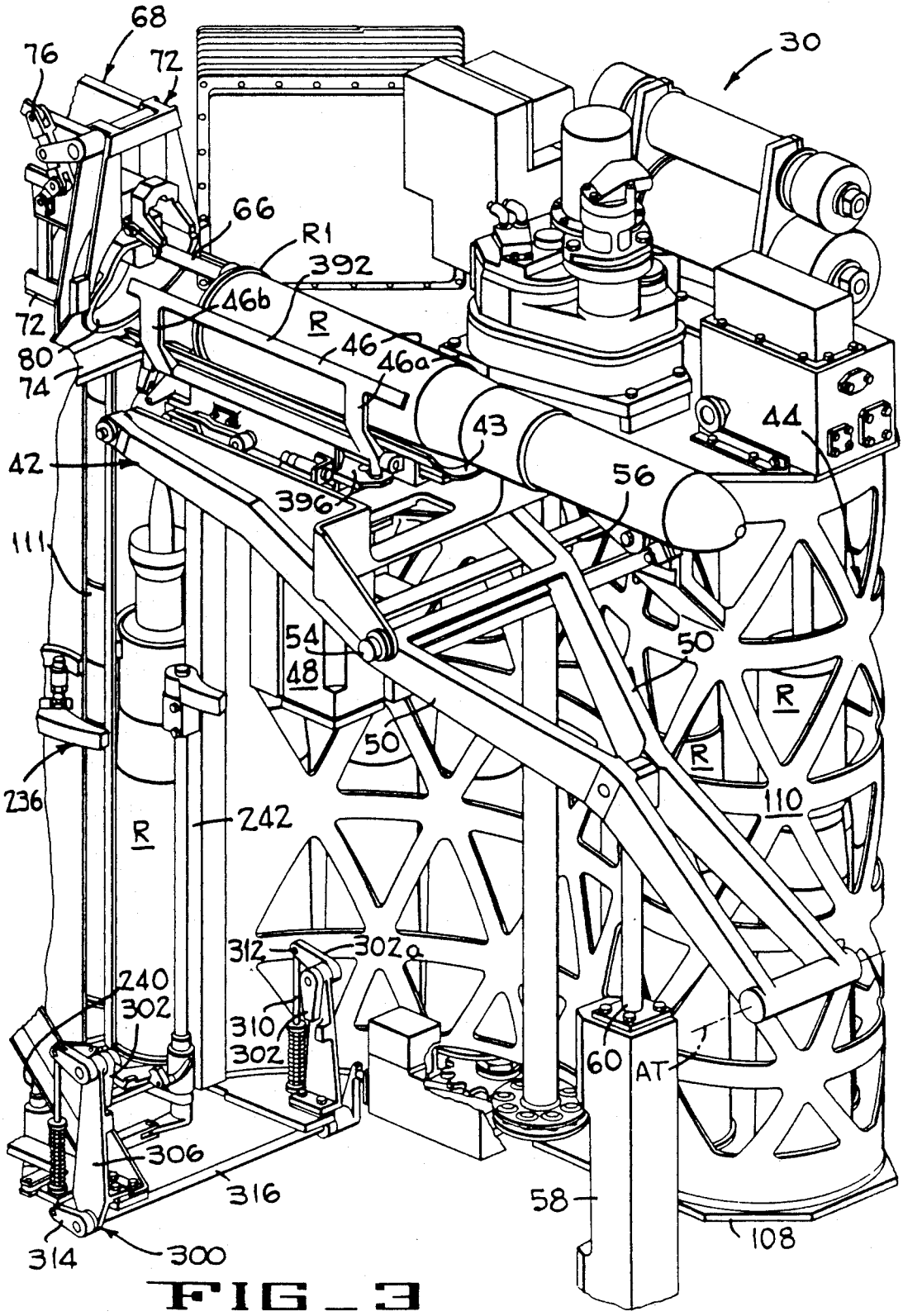
FIG. 3 is a perspective of a portion of the autoloader at a larger scale showing the selected round in the load tray in a generally horizontal 0° loading position with the round being partially rammed toward the gun.

FIGS. 3 and 5 illustrates the load tray support 42 pivoted up to its gun loading position by the cylinder 58 with a portion of the selected round R being guided by the open clamp arms 46 and rammed into the breech of the gun 33 (FIG. 5) with the breech block 64 shown in its raised open position.

A rammer 66 (FIGS. 3 and 5) of a rammer and empty case ejectory assembly 68 is shown in its lowered position ramming the round R into the gun 33. The rammer 66 of the assembly 68 is lowered to its illustrated round engaging position by a hydraulic cylinder 70 (FIGS. 4 and 5) that is rigidly secured to the frame 72 of the rammer assembly 68, which frame is bolted to an upper wall 74 of the magazine 44. The hydraulic cylinder 70 actuates a parallelogram linkage 76 which drives the rammer 66 into position to ram the round R into the gun 33, and is thereafter raised above the path of movement of the case C (or misfired round) after the round has been fired and the empty case C is being ejected from the autoloader 30 and vehicle 32 through an open reload-eject hatch door 78.

FIG. 4 illustrates the load tray support 42 in its retracted position adjacent the magazine 44. The rammer and empty case ejectory assembly 68 is provided with an empty case tray 80 that is shown extended to a position adjacent the breech of the gun 33. The tray 80 receives the empty case of the fired round and guides the case out of the autoloader 30 and vehicle 32 as previously described. During this phase of the operation, the rammer 66 is raised above the path of movement of the empty case C and engages the empty case by extending the piston rod of the cylinder 70 which shifts the parallelogram linkage 76 upwardly. Extractor fingers (not shown) in the conventional breech block 64 (FIG. 5) are cammed rearwardly in response to the breech block 64 moving upwardly to its open position which provides a sufficient velocity to propel the empty case C through the extended empty case tray 80 and outside the vehicle 32 as will be described in more detail hereinafter.

The turret 31 (FIGS. 6 and 7) is mounted on a non-rotatable armor plated base 84 that is rigidly secured to the vehicle 32 and has an annular upper end portion having an outer ball race 86 bolted thereto A plurality of ball bearings 88 are disposed between the outer ball race 86 and an inner ball race 90 which rotatably supports upper and lower rotatable portions 92,94 of the turret 31 to the non-rotatable portion 84 for rotation about a vertical axis ATV. The gun 33 is preferably a conventional 105 mm gun except that the breech block 64 opens upwardly rather than downwardly as in the conventional 105 mm.

The upper rotatable portion 92 is formed from armor plate and includes a gun cover 95 pivotally secured to the upper wall 96 at 98, and is also releasably secured to the upper wall by a conventional means. The gun cover 95 provides access to a gun and autoloader chamber 99 (FIG. 7) which is separated from a gunner and commander chamber 101 of the turret armored partition 102 (FIG. 7). The gunner 38 is provided with a periscope **38*a* (FIG. 1) and the commander is provided with a plurality of periscopes 40*a* to view the area on all sides of the vehicle 32. The gunner 38 and commander 40 enter the chamber 101 of the turret through a second hatch 103. When the hatch 103 is closed, the gunner and commander chamber 101** of the turret is sealed thereby providing protection against gases used in chemical warfare.

As shown in FIG. 6, the gun 33 is secured to a frusto-cylindrical mount 104 which is pivotally received within mating bearing surfaces 105 of the upper rotatable portion 92 of the turret 31. The gun 33 is driven in elevation about the axis of trunions 93 by conventional power operated hydraulic cylinders (not shown) which are provided to change the elevation of the gun 33. A conventional hydraulic motor and gear drive (not shown) are provided to rotate the upper portion 92 of the turret relative to the lower portion of the turret in azimuth.

It will be noted that the autoloader 30 and gun 33 rotate as a unit when the gun is swinging in azimuth about the generally vertical axis ATV of the turret thus greatly simplifying the several components of the autoloader when interfacing with the gun. All that is required is that the elevation of the gun be returned to the generally horizontal or 0° position illustrated in FIG. 6 when the autoloader is to be operated, thus eliminating the need for additional structure to align the axis of the round and empty cases with the gun axis when the gun axis is other than at the 0° position.

THE MAGAZINE

Figure 9:
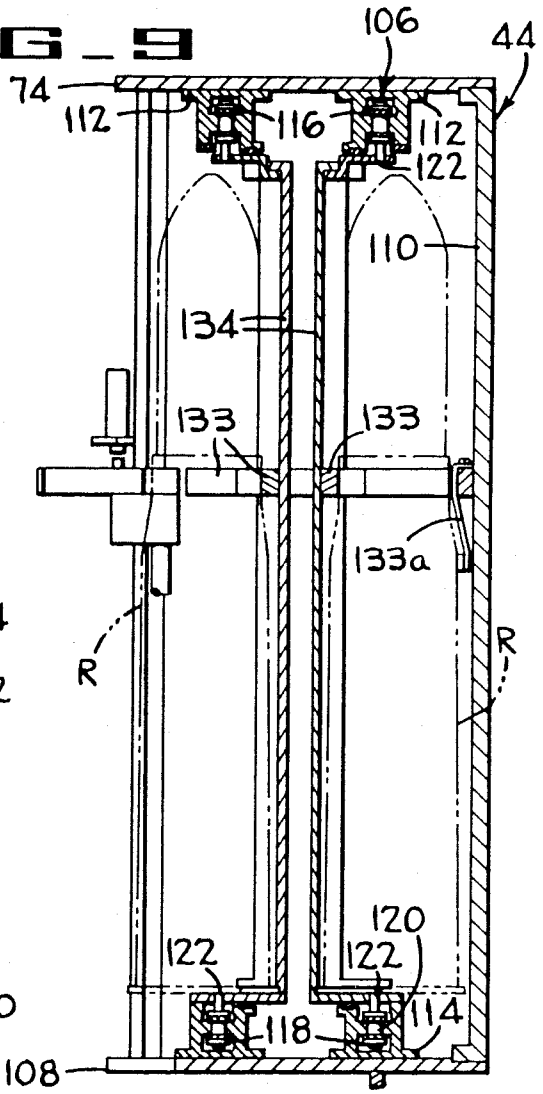
FIG. 9 is a section taken along lines 9—9 of FIG. 8.
Figure 10:
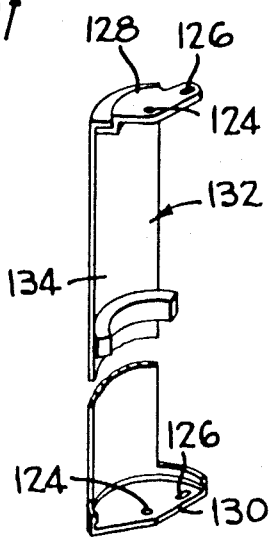
FIG. 10 is a perspective of a cartridge carrier.
Figure 8:
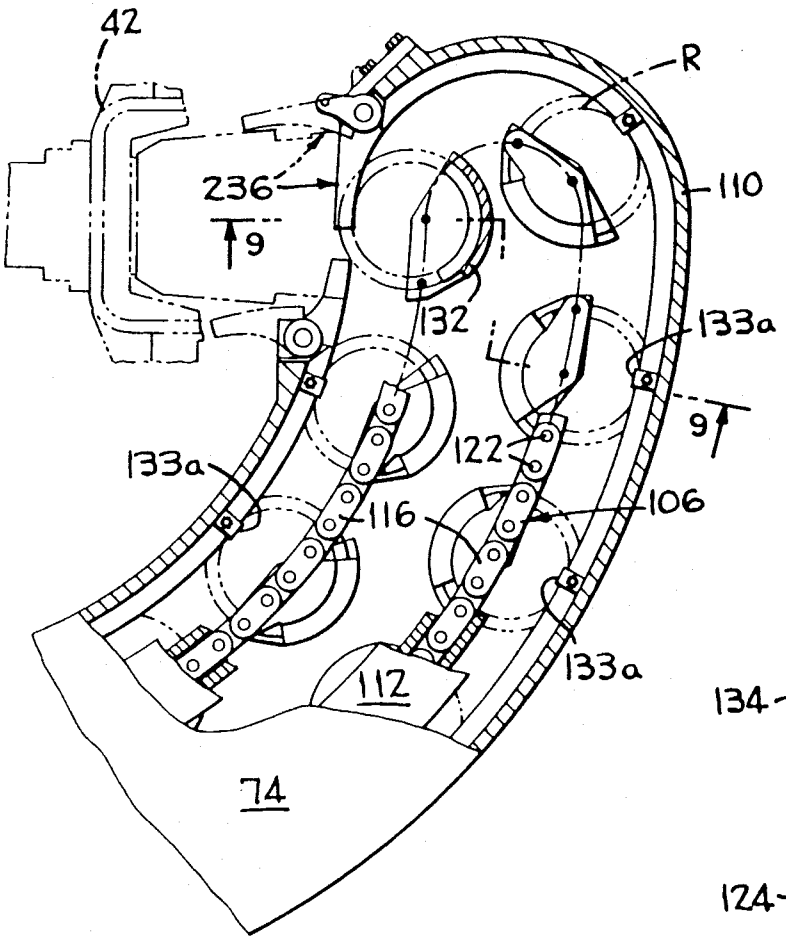
FIG. 8 is a plan view of a portion of the magazine with parts broken away to illustrate the magazine conveyor, its carriers, and the magazine loading-unloading station, the load tray assembly being shown in phantom.

The magazine 44 is kidney shaped as best shown in FIGS. 2, 6 and 7 and includes a magazine conveyor 106. The magazine also includes the top wa 74, a bottom wall 108 and a tall upright kidney shaped retaining wall 110 which is preferably of perforated metal with an upright opening 111 defining a magazine load-unload station through which rounds R may be moved when removing or replacing rounds in the magazine. As shown in FIGS. 8–10, upper and lower endless chain tracks 112,114 receive and guide upper and lower endless chains 116,118, respectively, along the kidney shaped path. The links include rollers 120 intermediate the ends of pivot pins 122, and the pivot pins 122 on certain ones of the upper chain 116 have extensions which project downwardly, while extensions of certain ones of the pins of the lower chain project upwardly. The pin extensions enter holes 124,126 (FIG. 10) in end plates 128,130 of associated cartridge carriers 132 for connecting a plurality of carriers, preferably 19, to the chains. The holes 126 are slightly elongated for permitting the carriers to move around the sharp curves at the ends of their kidney shaped path without binding. As shown in FIGS. 9 and 10, each carrier includes an arcuate vertical wall 134 of sufficient length (about 40 inches when handling 105 mm rounds) to accommodate the particular type of rounds R being used. Also, arcuate collars 133 are secured to each arcuate wall to engage the neck down portion of the cartridge case of the rounds to stabilize and maintain the rounds vertical while in the magazine 44. Spring fingers 33*a* are secured to the magazine retaining wall 110 at locations that will urge the rounds against the collars 133 when the conveyor 106 is stationary.

The magazine conveyor chains 116, 118 are driven in either direction by a hydrostatic motor 136 (FIGS. 2 and 11) supported on the upper wall 74 of the magazine 44 and drives a gear reducer 138. The motor drives a pinion 140 (FIG. 11) which drives a larger gear 142 keyed to a shaft 144 having a small gear 146 on its other end which meshes with a large gear 147 keyed to a splined output shaft 148 which engages a vertical conveyor drive shaft 149.

In order to transmit power from the drive shaft 149 (FIGS. 2 and 11) to the conveyor chains 116,118, upper and lower drive members 150,152, are rigidly secured to the drive shaft 149, only a fragment of the upper and lower drive members being shown in FIG. 2. Each drive member 150,152 includes upper and lower discs having a plurality of equally spaced rollers 154 journaled therebetween, which rollers mesh with corresponding upper and lower idler sprockets 156 (only the lower sprocket being shown) journaled on the upper and lower walls 74,108, respectively, of the magazine 44. The idler sprockets engage the rollers 120 (FIG. 9) on the upper and lower chains 116,118 to drive the magazine conveyor 106. The ratios of the above described gears and sprockets provide about a 30 to 1 reduction in speed between the motor drive shaft and the idler sprocket speed.

Figure 11:
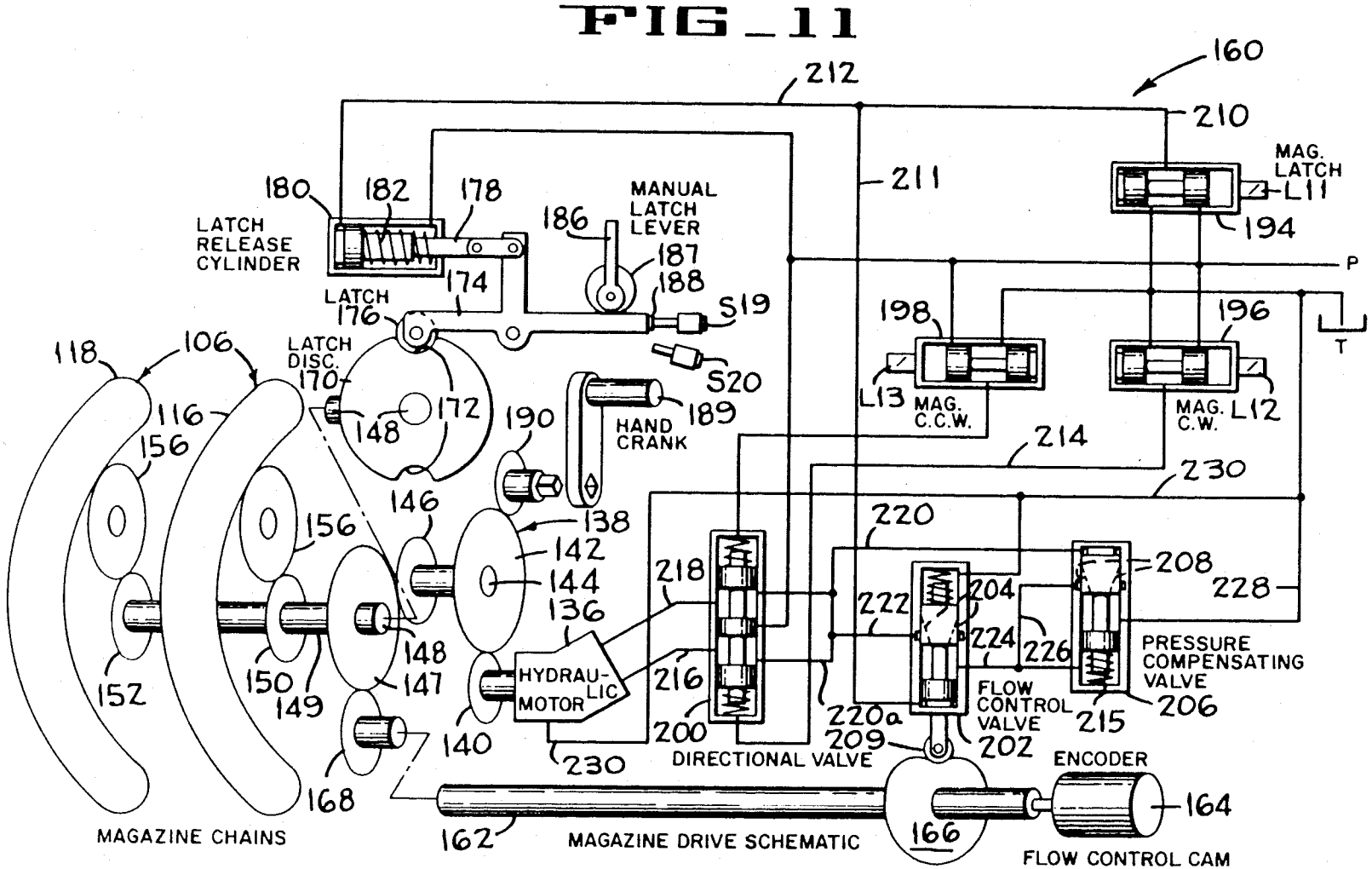
FIG. 11 is a schematic operational view illustrating the mechanical, hydraulic and manual components for operating the magazine conveyor.

Having reference to FIG. 11, a hydraulic and electrical control system 160 is disclosed for controlling the speed of movement of the conveyor drive shaft 148 and for stopping the conveyor with the desired cartridge tray 132 in precise position to transfer the associated rounds B between the load tray 43 and the magazine 44.

The mechanical components of the control system 160 includes a response shaft 162 that has an encoder 164, a flow control cam 166 and a gear 168 coupled thereto. The gear 168 meshing with gear 147 to drive the cam 166 and a rotatable portion of the encoder one revolution each time a cartridge carrier 132 is aligned with the cartridge loading-unloading station. A latch disc 170 having two latch notches 172 therein is secured to the splined output shaft 148. A latch arm 174 is pivotally supported by the magazine 44 and includes a roller 176 on one end which rides along the disc and enters either of two latch notches 172 to precisely stop a selected cartridge tray 132 at the load-unload station. The latch arm 174 is connected to the piston rod 178 of a latch release cylinder 180 that includes a spring 182 which normally urges the roller 176 against the latch disc 170. When the piston rod 178 is extended the roller 176 is spaced from the latch disc 170. Magnetic switches S19 and S20 are activated by a magnet 188 on arm 174 to indicate the roller 176 is engaged or disengaged, respectively.

If it is desired to manually operate the magazine conveyor 106, a latch release lever 186 having an eccentric cam 187 thereon may be rotated to raise and lock the roller 176 in an inoperative position at which time a magnetic switch S19 is deactivated and a switch S20 is activated by a magnet 188 on the arm 174. When the latch arm is in its inoperative position, a hand crank 189 may be connected to a gear 190 that meshes with the gear 142 thus driving the magazine conveyor in either direction depending upon which direction the crank is turned.

The control system 160 (FIG. 11) includes a solenoid operated magazine conveyor latch release valve 194, and two solenoid operated magazine directional valves 196 and 198 which when solenoids L12 and L13 are energized cause the conveyor to be driven in a clockwise or a counterclockwise direction, respectively A spring centered directional valve 200; a spring loaded flow control valve 202 having orifices 204 therein; and a spring loaded pressure compensating valve 206 having orifices 208 therein are also included in the electrical and hydraulic control system 160. A cam follower 209 is connected to the core of the spring loaded control valve 202 and is lifted off the cam 166 in response to high pressure fluid from conduit 211 acting on the core thereby fully opening the flow control orifice 204.

In order to drive the magazine conveyor 106 (FIG. 11) to position the selected round R at the load-unload station, either as ordered by the loader control or by manually closing switches (not shown), the solenoid L11 is energized thereby directing high pressure hydraulic fluid from pressure line P through valve 194, conduits 210,212 thereby extending piston rod 178 of latch release cylinder 180 thus withdrawing roller 176 out of engagement with latch disc 170. At the same time, high pressure fluid also flows through conduit 211 to urge the roller 209 and core of flow control valve 202 upwardly (FIG. 11) out of engagement with flow control cam 166 thereby fully opening orifices 204 against the urging of a spring 215.

It will be appreciated that a much greater hydraulic force is provided on the left side of the piston 178 as compared to that on the right side since a smaller effective area of the right side of the piston is contacted by the high pressure fluid due to the presence of the rod on the right side. Thus, the hydraulic force acting on the left side of the piston is greater than the force of the spring plus the hydraulic force acting on the right side of the piston, causing the piston to move to the right even though the conduit to tank T is closed. The same amount of fluid discharged from the right side of the latch release cylinder 180 will pass through open valve 194 and will enter the left side of cylinder 180. Thus, no fluid returns to tank during this portion of the operation.

If the conveyor 106 is to be driven in a clockwise direction to index a round R and its carrier 132 at the load-unload station, solenoid L12 is energized thus directing high pressure fluid from pressure line P through valve 196. High pressure fluid then flows through conduit 214 into the bottom (FIG. 11) of directional valve 200 causing its core to shift upwardly thus causing high pressure fluid from conduit P to flow through directional valve 200 and conduit 216 to drive the hydrostatic motor 136 and magazine conveyor 106 in a clockwise direction. Low pressure fluid discharging to tank T through conduit 218, valve 200, conduits 220,222, fully opened orifice slots 204 in flow control valve 202, conduits 224,226, orifices 208 in pressure compensating valve 206, and conduit 228 to tank T. Conduits 230 and 228 drain the housing of motor 136 to tank T.

The hydrostatic motor 136 starts rotating at maximum torque because there is substantially no resistance from flow control orifices 204 or 208 in the return line to tank T. As the speed of the motor increases, the pressure in the return line increases until a near constant speed is reached with little differential pressure across the motor 136. The pressure compensating valve 206 senses the pressure drop across the flow control orifice 204 and maintains the pressure at a constant amount by further throttling the flow. This makes the flow, and thus the motor speed, dependent only upon the flow control orifice area regardless of the number and weight of the rounds R in the magazine 44.

When the motor 136 has driven the selected round to one-half a station away from the cartridge load-unload station, the encoder 164 on the response shaft 162 indicates this condition to the control. The solenoid L11 of the latch release valve 194 is then deenergized thus shifting the valve to the illustrated position (FIG. 11) which opens the case end of the latch relief cylinder 180 to tank T causing the roller 176 on latch arm 174 to ride along the periphery of the latch disc 170 and then drop in the next adjacent notch 172 to precisely stop the selected round at the cartridge load-unload station. When the encoder de-energizes solenoid L11 and shifts the valve 194 into the illustrated position (FIG. 11) the lower end of the flow control valve is vented to tank T through conduits 211,210 and valve 194 thus lowering the cam follower 209 onto the flow control valve cam 166. The contour of the cam 166 is such that downward movement of the core of the flow control valve gradually reduces the area of the orifices 204 thus bringing the magazine conveyor drive to a near stop as the latch roller 176 is urged into the adjacent notch 172 in the latch disc 170 with the selected round R (or empty cartridge carrier 132) aligned with the cartridge load-unload station.

If one or more rounds must be indexed past the magazine load-unload station in order to align the selected round with the station, the encoder 164 allows the magazine conveyor 106 to be driven at constant speed past the load-unload station until the selected round is one-half station away from the load-unload station at which time the above described conveyor stopping procedure is started.

If the conveyor is to be driven in a counterclockwise direction, the above described procedure is repeated except that the solenoid L13 of valve 198 is energized, causing directional valve 200 to shift downwardly thus driving the motor 136 in a counterclockwise direction with the low pressure fluid discharging to tank T through conduits **216,220*a*,222, orifices 204, conduits 224,226, orifice 208 and conduit 228** to tank T.

MAGAZINE LOAD-UNLOAD STATION

The magazine load-unload station is positioned on the convex side of the magazine 44 (FIG. 2) adjacent a small diameter end of the magazine. The vertical load-unload port 111 in the magazine retaining wall 110 permitting rounds R to pass therethrough in either direction.

A magazine gate assembly 236 (FIGS. 2 and 12) is secured to the magazine retaining wall 110 for retaining rounds R in the magazine 44 when closed, and to guide rounds into or out of the magazine when opened. The gate assembly 236 comprises a pair of upper cartridge restraining and guiding arms 237,238 secured to the upper ends of pivot shafts 240,242, respectively. The pivot shafts are journaled in brackets 243,244 (FIG. 12) secured to the upper portion of the magazine retaining wall 110, and in two lower brackets 108 secured to portions of the bottom wall 108 of the magazine 44. The restraint arms are positioned to contact the neck down portions of the cartridge cases C and are contoured to smoothly guide rounds when traveling past the magazine load-unload station and also when being moved into or out of the station.

The gate assembly 236 also includes a lower cartridge restraint 245 that is secured to a transverse shaft 246 that is perpendicular to the axes of the pivot shafts 240,242. The transverse shaft 246 is journaled to the bottom wall 108 (FIG. 2) of the magazine by bearings (not shown). The lower restraint 245 includes a cartridge supporting and guiding base 248 and an upstanding arcuate wall 250 to guide the flanges of the rounds through the magazine when in the position illustrated in FIG. 12. The base 248 and arcuate wall 250 each have slots 252,254 therein to provide clearance for other components during the loading and unloading operation. A roller 256 journaled on one end of the lower restraint 245 rides in a cam groove 258 in a collar pinned to the shaft 240. Thus, rotation of the shaft 240 from the closed position illustrated in FIG. 12 to an open position (not shown) will also rotate the flanges arcuate guide wall 250 below the rounds when being transferred through the gate assembly 236.

The shafts 240,242 are rotated by a hydraulic cylinder 259 mounted on the underside of the magazine bottom plate 108 and has a piston rod 260 pivotally connected to a lever 261 pivoted to the magazine bottom plate 108. The lever 261 is pivotally connected to crank arms 262,264 that are pinned to shafts 240,242, respectively. The crank arm 262 is pivoted to the arm 264 by a link 266 and the crank arms 261 and 264 are pivotally connected together by a link 268.

Figure 12:
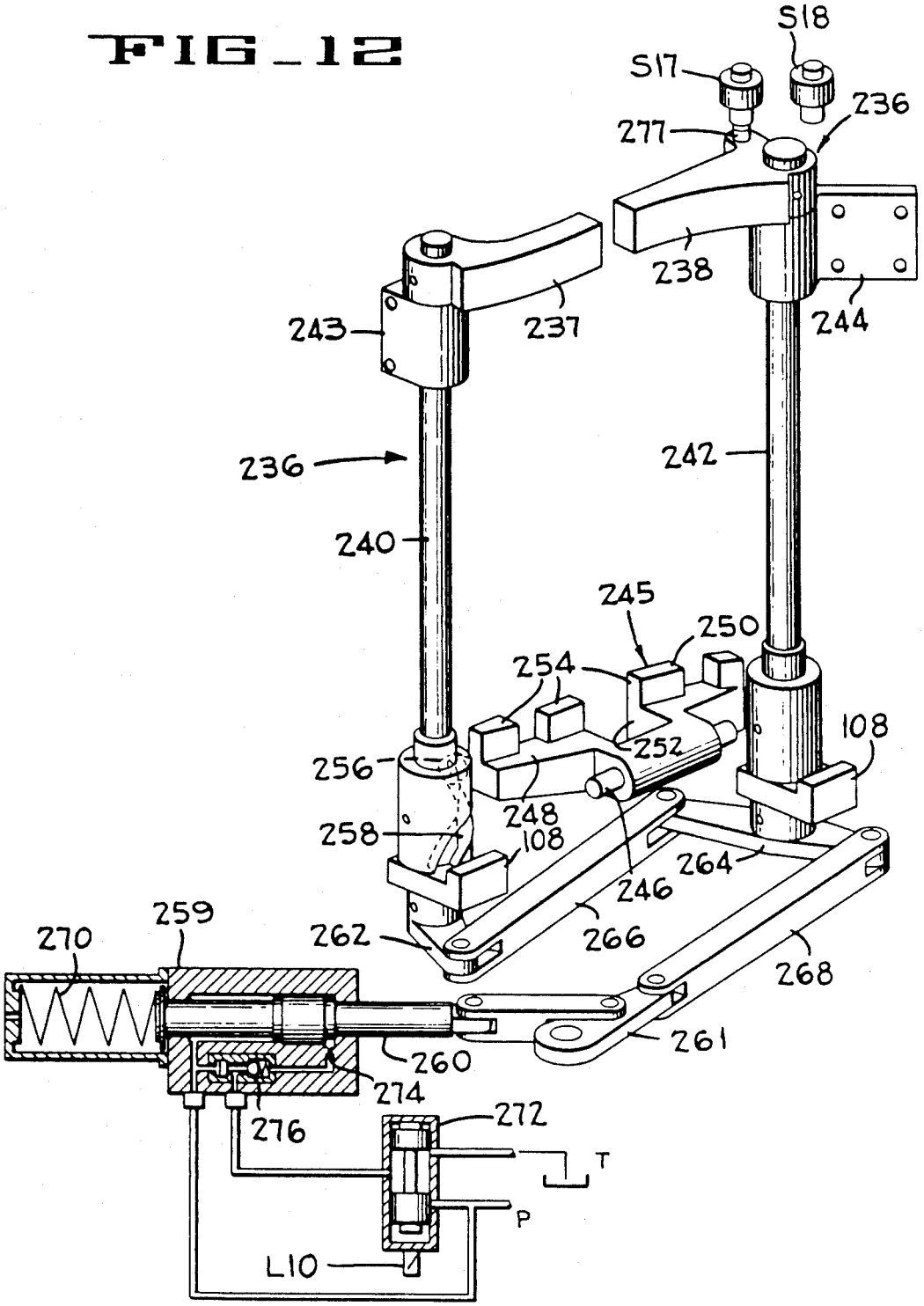
FIG. 12 is a schematic operational view illustrating the gate operating mechanism at the magazine load-unload station

The piston rod 260 of the cylinder 259 is normally held in the illustrated extended position by hydraulic pressure at the case end of the cylinder aided by a spring 270 which maintains the restraining arms 237 and 238 closed when the system pressure is off. When the arms of the gate assembly 236 are closed, the lever 261 and the link 268 are in line thus locking the restraining arms and cartridge guide base 248 in their magazine closing position as illustrated in FIG. 12.

A two way solenoid valve 272 is provided to control operation of the cylinder 259. When the solenoid L10 of valve 272 is de-energized as illustrated in FIG. 10 (and also when it is energized) high pressure fluid from source P bypasses the valve and urges the piston rod 260 toward its extended position thus closing the gate assembly. Fluid in the rod end of the cylinder is returned to tank T through an orifice 274, a pilot operated check valve 276 which is held open by high pressure fluid, and through valve 272 to tank T. When the solenoid L10 is energized, the core of valve 272 shifts to close the conduits to tank T and to direct high pressure fluid to the rod end of the cylinder through the check valve 276 and orifice 274 thus retracting the piston rod 260 and opening the gate assembly 236. Although equal pressure per square inch is applied to both ends of the piston of the piston of cylinder 259, it will be noted that the area of the two sides of the piston contacted by fluid differs. Thus, the piston opens. The pilot operated check valve 276 locks the gate assembly 236 in the open position in the event system pressure is lost permitting the load tray support 42 to retract to the stowed position.

It will be noted that magnetic switch S17 is closed by a magnet 277 on the gate arm 238 when the gate arms are closed, and that a switch S18 will be closed when the gates are open.

As illustrated in FIG. 7 provision is made for the driver of the vehicle 32 to manually load rounds into or out of the magazine from a supply of rounds stored within the vehicle but externally of the turret 31. For this purpose an opening (not shown) is provided in the turret and another opening is provided in the outer wall 110 of the magazine which is normally closed by a gate 280. The gate is pivoted at 282 to the wall and is normally locked in the illustrated closed position by a latch 284. A magnet 286 on the latch energizes a magnetic switch 288 when the manually operated gate is closed, which completes the electrical circuit to the magazine index drive and allows the conveyor to be driven.

In order to load the magazine, the turret 31 is pivoted to move the gate 280 to a position directly behind the vehicle driver, who gains access by pivoting 180° in his seat. The conveyor is then driven to position empty cartridge carriers 132, one at a time, to a position adjacent the gate 280 and the stored rounds R are loaded one at a time into the magazine and then the latch is closed. If rounds are to be removed from the magazine to replenish the supply of stored rounds in the vehicle, the above operation is reversed.

Figure 13:
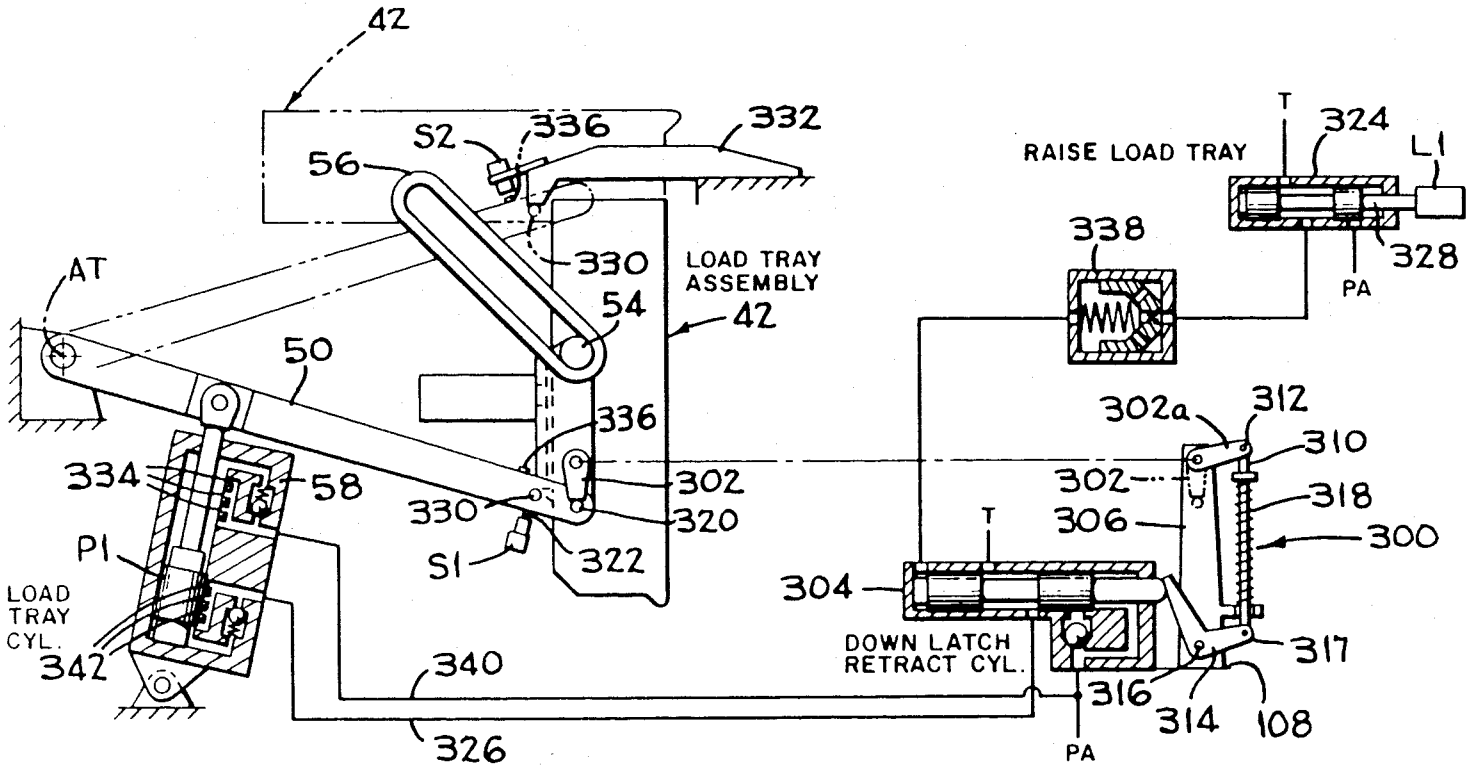
FIG. 13 is a schematic operational view of the load tray pivoting mechanism and the load tray down latch.

The load tray support 42 is moved between the lowered retracted position shown in FIGS. 2, 13 and the upper load position shown in FIG. 3 and in the phantom line position of FIG. 13 by the tray pivoting cylinder 58. The load tray assembly is releasably latched in the retracted position by a down latch assembly 300 when the tray pivoting cylinder 58 is retracted. The down latch assembly 300 includes a pair of latch arms 302 (FIG. 3) with one latch arm 302 adjacent each free end of the Y-shaped arm 50 (FIGS. 2–4, 13). The two latch arms are connected by a cross shaft 316 (FIG. 3). The same latch arms 302 are shown twice in FIG. 13, once to show the operation of the arm 302 relative to the arm 50 and once to show the operation of a down latch retract cylinder 304. Although two latch arms are provided as illustrated in FIG. 3, in order to simplify the disclosure, the following description will refer to only one arm.

The latch arm 302 (FIG. 13) is pivotally mounted on an upright member 306 which is connected to a magazine bottom plate 108. A horizontal portion 302*a* of the latch arm is connected to a rod 310 by a pin 312. A lower arm 314 is pivotally connected to a lower portion of the upright member 306 and one end of the arm 314 is connected to the lower end of rod 310 by a pin 317. Arms 302 and 314 are biased n the position shown in FIG. 13 by a spring 318 When cylinders 58 and 304 are retracted as illustrated, the load arm 50 is retained in the lowered position (FIG. 13) by arms 302 which each contact a pin 320 on a lower end of arm 50 to ensure that arm 50 is held down. A magnet 322 on arm 50 actuates a switch S1 which closes a circuit to indicate that arm 50 is in the lowered position With the load tray support 42 in the lowered position the pistons of cylinders 58, 304 and of a solenoid valve 324 are as shown in FIG. 13. Fluid from a source of pressurized fluid P holds the piston of cylinder 58 in the downward position and holds piston of cylinder 304 in the left hand position. A spring holds the piston of solenoid valve 324 in the left hand position.

When it is desired to raise the load tray support 42 (FIG. 13) the solenoid L1 is energized which causes the piston of the solenoid valve 324 is shifted to the right so pressurized fluid from source P moves through valve 324 to the left end of cylinder 304 thereby shifting the piston of cylinder 304 to the right. The piston in cylinder 304 moves a piston rod 328 to the right causing arm 314 to pivot clockwise (FIG. 13) lowering rod 310 and pivoting latch arm 302 clockwise to unlatch loader arm 50 so arm 50 can be raised. Pressurized fluid from source P is coupled through cylinder 304 to the lower end of load tray cylinder 58 by a hydraulic line 326. The pressure in line 326 moves a piston P1 in cylinder 58 upward forcing load arm 50 to pivot upward about axis AT causing the attached load tray support 42 to move upward Fluid pressure from source P is applied to the top and bottom of piston P1, however the greater area on the bottom of piston P1 causes a greater amount of upward force As piston P1 moves upward roller 54 moves upwardly in track 56 causing load tray support 42 to move from the retracted position shown in the solid lines of FIG. 13 to the upper load position shown in the phantom lines in FIG. 13. A fixed pin 330 and a tray stop 332 limit the upward travel of loader arm 50 and load tray support 42 which assumes its generally horizontal or 0° position. A plurality of orifices 334 limit the rate of fluid flow from the upper cavity of cylinder 58 and thus limit the maximum upward speed of piston P1. Also the piston P1 closes these orifices sequentially to decelerate the upward movement of loader arm 50 and load tray support 42. A magnet 336 on arm 50 actuates a switch S2 which closes a circuit to indicate that arm 50 is in the upper load position.

When the solenoid L1 is energized the piston of the solenoid valve 324 (FIG. 13) moves to the left and fluid in the left end of down latch retract cylinder 304 flows through an orificed check valve 338 and solenoid valve 324 to a tank T allowing the piston in cylinder 304 to be moved to the left by spring 318 and to pivot lower arm 314 to its illustrated position. The lower end of cylinder 58 is vented to tank T through cylinder 304 so piston P1 is moved down by pressure in hydraulic line 340. A plurality of orifices 342 limit the downward speed of piston P1 and decelerate the piston speed as P1 sequentially closes the orifices 342.

Figure 14:
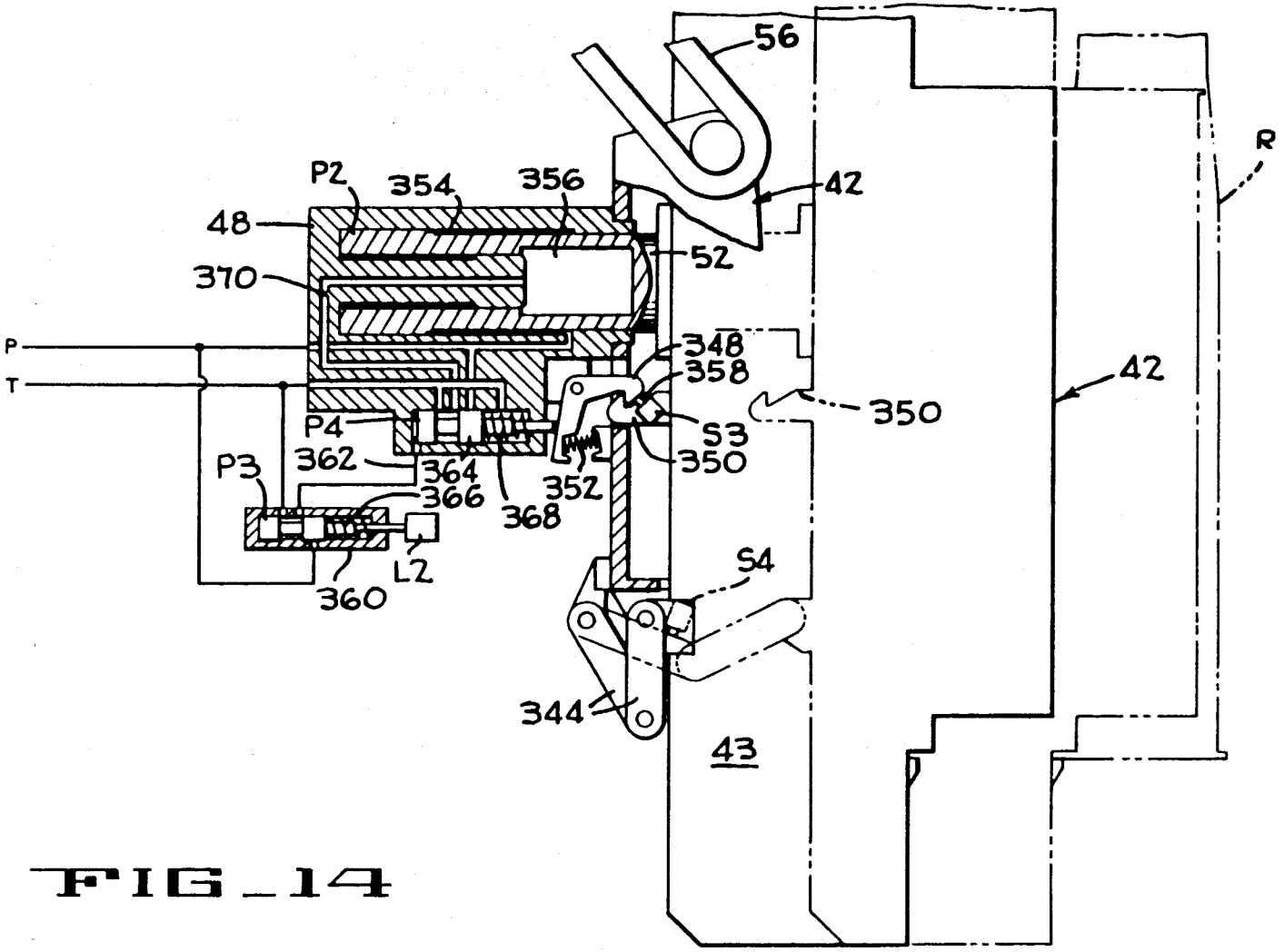
FIG. 14 is a schematic operational view of the load tray translate drive and retract latch.

When the load tray support 42 (FIG. 13) is in the lowered retracted position, a load tray translate drive moves the load tray 43 (FIGS. 2, 14) into the load station of the magazine, where the load tray clamps onto a selected cartridge or round R in the magazine 44. After the magazine gate assembly 236 is opened, the load tray translate drive moves the cartridge R out of the magazine and into position to be raised to the level for loading the cartridge into the gun breech. The load tray translate drive includes the large cylinder 48 attached to the load tray support 42 and a piston P2 connected to the load tray 43 by the piston rod 52 (FIGS. 2, 14). A pair of stabilizing links 344 pivotally connect the lower end of the load tray 43 to the load tray support 42. The stabilizing links prevent rotation of the load tray relative to the load tray support. The load tray 43 is held retracted to the load tray support 42 (FIG. 14) by a retract latch 348 and a latch hook 350 when the translate drive piston P2 is in the retracted position shown in FIG. 14. The latch hook 350 is secured to the load tray 43 (FIG. 14) and the retract latch 348 is pivotally connected to the load tray support 42. The retract latch 348 is biased into a lock position by a spring 352 to retain the load tray in a retracted position when hydraulic and control power are off. A magnet 358 on latch 348 actuates a switch S3 which closes a circuit to indicate that the load tray 43 is latched in the retracted position.

A differential area 354 (FIG. 14), between the piston P2 and the rod 52 is always pressurized to bias the piston P2 to the retracted position shown in FIG. 14. A bore 356 in the piston rod 52 has an area approximately twice the area of the differential area 354 so the piston can be extended by applying fluid to bore 356.

To extend the load tray 43 (FIG. 14) a core P3 of a solenoid operated valve 360 is moved to the right by energizing solenoid L2 to conduct pressurized fluid from a source P to an input line 362 of a latch release cylinder 364. The fluid in line 362 moves a piston P4 to the right causing latch 348 to be released and porting pressurized fluid to the bore 356 in the piston rod causing the rod 52 to extend the load tray to the right (FIG. 14). To retract the load tray 43 (FIG. 14) the solenoid L2 is deenergized so the core P3 of valve 60 is retracted to the left by a spring 366, fluid from cylinder 364 and line 362 is returned to the tank T. A spring 368 returns piston P4 to the left (FIG. 14) porting fluid from the bore 356 to the tank T and allowing pressurized fluid in the differential area 354 to retract piston P2 and thus retract load tray 43. An orifice 370 in the line to bore 356 controls the speed of both extend and retract cycles of the load tray.

Figure 15:
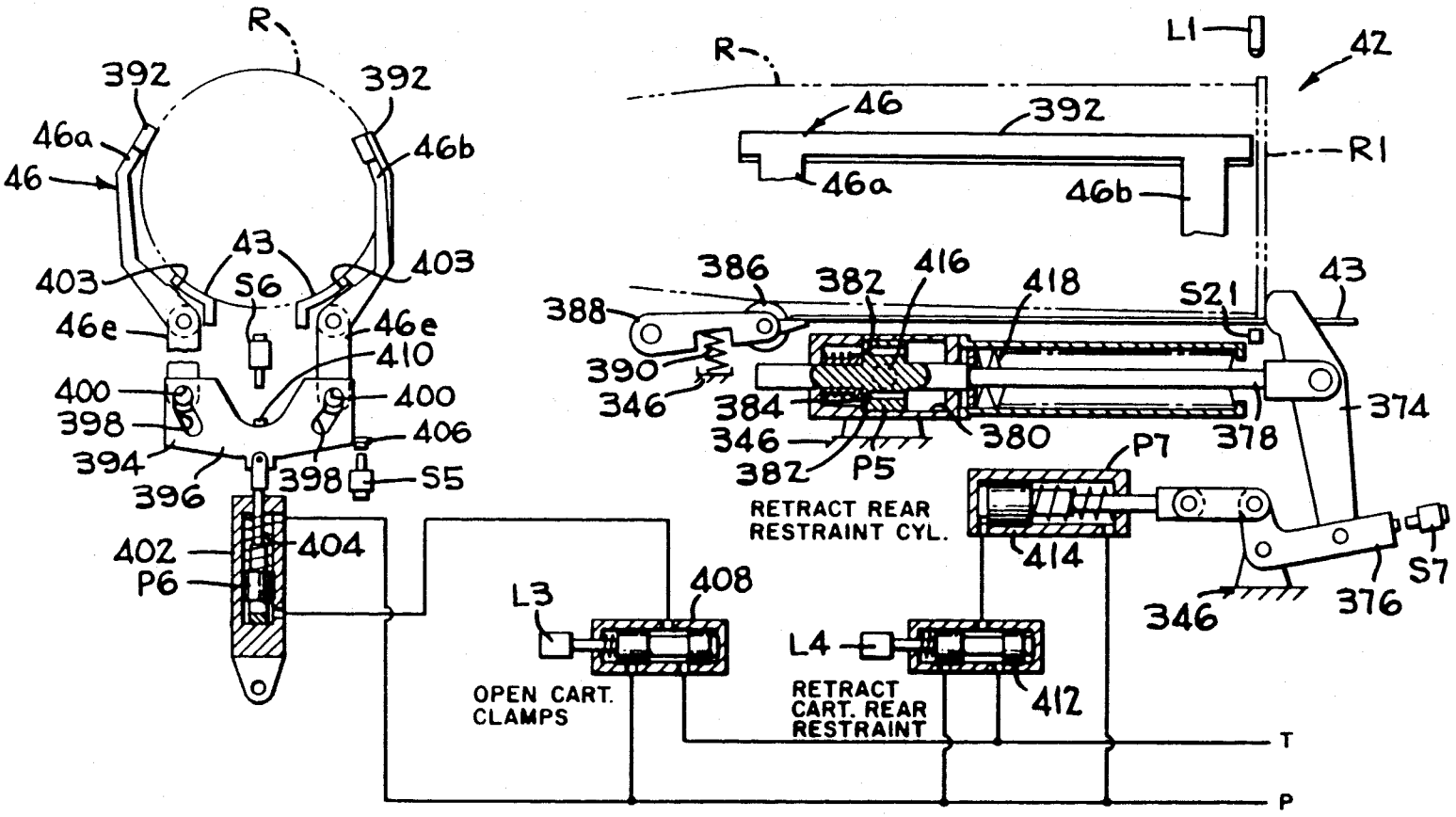
FIG. 15 is a schematic operational view of the several hydraulically operated components of the load tray.

The load tray 43 (FIG. 14) includes the load tray for supporting a cartridge R while the cartridge is moved from the magazine and transported to the breech of the gun, and further includes a pair of cartridge clamps 46 for securing the cartridge to the load tray 43. The right portion of FIG. 15 is a schematic of a side view of the load tray while the left portion of FIG. 15 is an end view. The various valves and hydraulic cylinders for controlling operation of the load tray and cartridge clamps are also shown in FIG. 15.

The base or flange R1 (FIG. 15) of the cartridge R is engaged by one end of a cartridge restraint lever 374 and the other end of lever 374 is pivotally connected to a crank 376. A spring loaded rod 378 is pivotally connected to the lever 374 to establish the normal position of the lever 374. A cylinder 380 having a piston P5 with a plurality of orifices 382 in the piston forms a dashpot. Approximately 95% of the orifices 382 are closed against fluid flow from left to right through piston P5 by a spring loaded check sleeve 384. The cylinder 380 is trunnion mounted to the load tray 43.

A forward support roller 386 (FIG. 15) contacts the cartridge R at the main tapered body of the cartridge case to support the cartridge R parallel to the load tray 43. The roller 386 is rotatably mounted on an arm 388 which is pivotally to the support 346. A spring 390 provides support for the arm 388 and the upward travel of the arm 388 is limited by the load tray 43. The roller 386 is pushed down by the flange R1 of the cartridge which is guided by the arms 46*a*, 46*b* of the cartridge clamps 46 when the cartridge R is being moved off the tray 43.

Each of the cartridge clamps 46*a*, 46*b* (FIGS. 2, 32, 3, 15) includes a forward arm 46*a*, a rear arm 46*b* and an interconnecting bar 392. Each of the arms 46*a*, 46*b* is pivotally mounted to the load tray 43 with the forward arms 46*a* each having an extension 463 which engages a clamp operating mechanism 394. The mechanism 394 includes a plate 396 having a pair of cam slots 398 which each receive a roller 400 which is rotatably connected to a corresponding arm extension 46*e*. The plate 396 (FIG. 15) is diagrammatically illustrated in FIG. 15 as being moved at right angles to the cartridge R by a translate drive cylinder 402 to open and close the forward support arms 46*a* although the plate is mounted horizontally as shown in FIG. 3. The interconnecting bars 392 cause the rear arms 46*b* to open and close along with the forwad arms 46*a*. When the clamps are closed the rear arms 46*b* contact a pair of stop pads 403 which are configured to cause the clamps to closely fit the diameter of the cartridge R, with the rear ends of the bars just ahead of the base R1 of the cartridge. The forward arms 46*a* continue to rotate to a greater angle of closed rotation than the rear arms 46*b* causing a small amount of twist in the pivot shafts and in the clamp bars thereby loosely clamping the cartridge. When the clamps are open the bars 392 are parallel with sufficient space between the bars to guide a cartridge into the gun magazine.

A source of pressurized fluid P (FIG. 15) is coupled to the upper portion of drive cylinder 402 and a spring 404 also biases a piston P6 downward (FIG. 15) so plate 396 and rollers 400 hold arms 46*a*, 46*b* in a clamped position. If hydraulic power should be lost, spring 404 retains the arms in the clamped position. A magnet 406 on plate 396 actuates a switch S5 which closes a circuit to indicate that the arms are in the clamped position.

When a solenoid L3 (FIG. 15) is energized shifting the core of solenoid valve 480 to the left, fluid from source P flows through the valve 408 to the lower end of piston P6 causing the piston P6 to move upward (FIG. 15) as the lower area of P6 is greater than the upper area of P6. The upward movement of piston P6 and plate 396 causes the clamp arms 46*a*, 46*b* to open so the cartridge R can be moved onto or off of the load tray 43. A magnet 410 on plate 396 actuates a switch S6 which closes a circuit to indicate that the clamp arms are in the open position. The clamp arms are open before the tray is moved into the magazine to retrieve a cartridge. The arms are then closed, the load tray is removed from the magazine and the tray raised to align with the gun breech. The clamps are opened just before the cartridge is rammed into the gun, with the clamps forming a chute for the cartridge base R1 to pass through.

When a cartridge is to be unloaded from the load tray (FIG. 15) the cartridge rear restraint lever 374 must be moved downward. This is done by energizing a retract cartridge rear restraint solenoid L4 shifting the core of solenoid valve 412 to the left which ports pressurized fluid from source P to the end of a retract rear restraint cylinder 414 forcing a piston P7 to the right as the left area of piston P7 is greater than the right area. The moving piston P7 causes the crank 376 to rotate clockwise pulling restraint lever 374 down and rotating cylinder 380 clockwise about a pivot 416.

To unload an unfired cartridge from the gun and return it to the magazine, the load tray 43 is raised to align with the gun, the clamps 46 are open and the breech is opened ejecting the cartridge into the load tray 43 where it is stopped by the rear restraint lever 374 pulling against a spring 418 and the dashpot in cylinder 380. As the cartridge contacts the restraint lever 374 the cartridge R also breaks light between a light source L1 and an optical switch S21 which provides a signal causing the clamps to be closed. The clamps are closed before the spring 418 returns the cartridge restraint lever 374 to its normal position so the cartridge case flange R1 contacts the ends of the clamp bars 392. The rest of the unload cycle is then the reverse of the load cycle previously described.

When reloading the magazine turret, the load tray 43 is brought up to a horizontal position adjacent the gun breech, the clamps 392 are closed, the rear restraint lever 374 is lowered and the reload-eject door 78 (FIG. 5) is open. A cartridge is manually pushed through the rammer and empty tray ejector assembly 68 when positioned in FIG. 5, and onto the load tray 43 until the base R1 is stopped against the ends of the cartridge clamp bar 392. The rear restraint lever 374 is then raised and the cartridge put into the magazine in the same manner as described above in the unload cycle. An off loading operation is accomplished in the reverse order of the loading of the magazine turret. A staff with a soft cushion on one end and a hook on the other aids in the manual operations.

Figure 16:
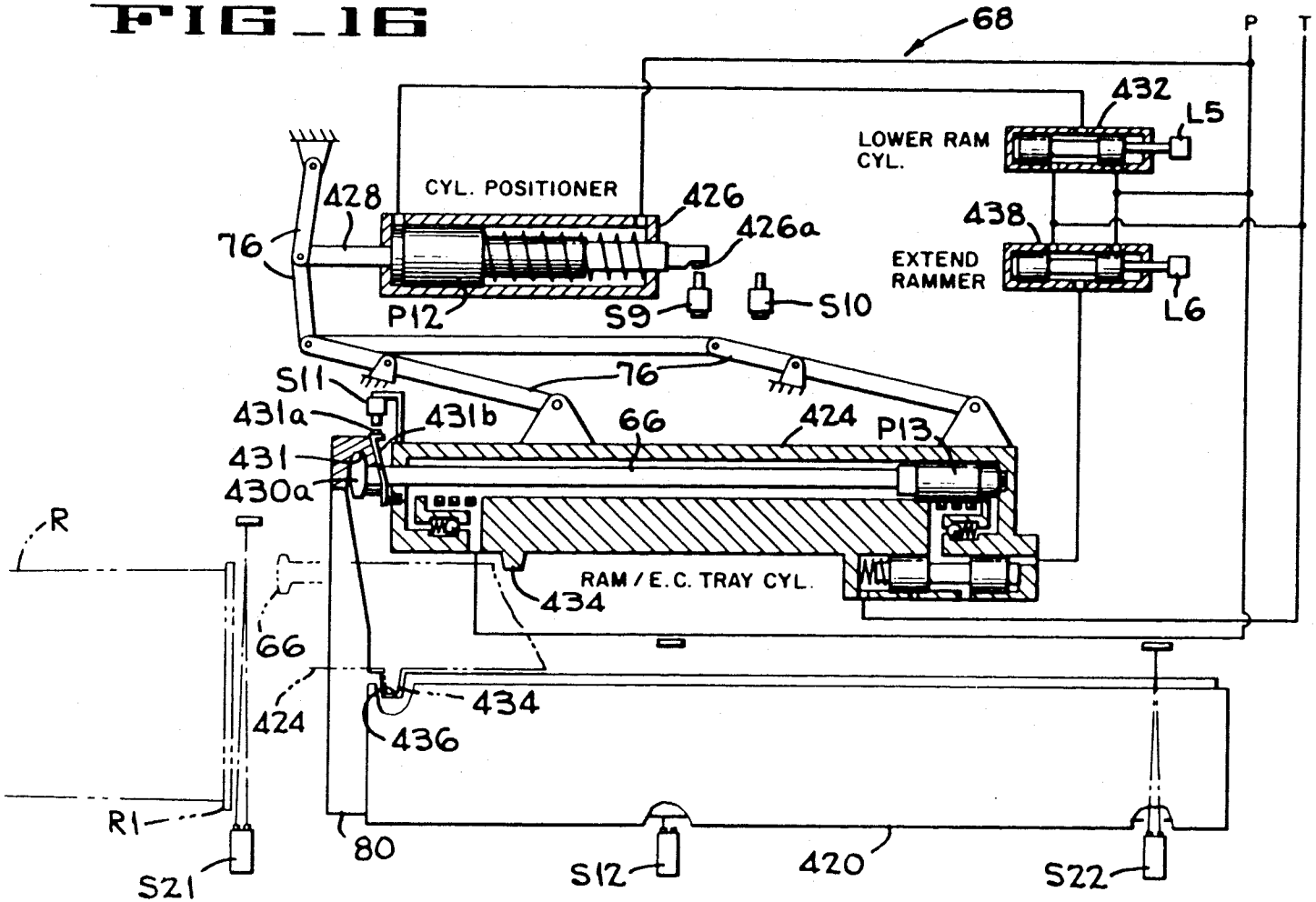
FIG. 16 is a schematic operational view of the rammer and empty case eject tray.

The rammer and empty case eject tray 68 (FIGS. 4, 5 and 16) includes a fixed tube 420, mounted to the upper wall of the magazine 74, and an inner telescoping tube or empty case tray 80 slidably mounted in the fixed tube 420. When the inner tube 80 is in the extended position (FIG. 4) the combination of tubes 420 and 80 span a distance between the rear of the gun breech and the rear wall of the turret 31 (FIG. 6) to guide an ejected cartridge from the gun 33 out through the eject hatch door 78. A ram-empty case cylinder 424 (FIG. 16) is movably supported by the parallelogram linkage 76 so that in the "up" position cylinder 424 operates the inner tube 80 (FIGS. 4, 16) and in the "down" position cylinder 424 is aligned with the cartridge R in the load tray 43 (FIGS. 3, 16).

Pressurized fluid from the source P (FIG. 16) is coupled directly to the right end of a cylinder 426 causing a piston P12 to be biased to the left end of cylinder 426. With piston P12 at the left end of cylinder 426 a rod 428 and linkage 76 hold cylinder 424 in the up position where a pad 430*a* on the end of a rod 66 engages a notch 431 in the inner tube 80 so cylinder 426 can extend and retract the inner tube 80 relative to the fixed tube 420 (FIGS. 2, 4, 16).

A magnet 426*a* on one end of piston P12 actuates a switch S9 which closes the circuit to indicate that cylinder 424 is in the up position. Pressurized fluid from the source P (FIG. 16) is coupled directly to the left end of a cylinder 424 causing a piston P13 to be biased to the right end of cylinder 424. A magnet 431*a* on a bell crank 431b which is actuated by a pad 430*a* on the end of rod 66 actuates a switch S11 which completes a circuit to indicate that rod 66 is fully retracted.

When a lower ram solenoid L5 (FIG. 16) is energized shifting the core of solenoid valve 432 to the right pressurized fluid from a source P flows through the valve 432 to the left end of cylinder 426 causing piston P12 to move to the right, due to the larger area on the left end of piston P12. The movement of piston P12, rod 428 and linkage 76 lowers the cylinder 424 into the down position in the phantom lines in FIG. 16. A cross pin 434 on the cylinder 424 engages a groove 436 to secure the cylinder 424 to the inner tube 80 when the rammer or cam rod 66 is actuated. A magnet 431*a* on the end of piston P12 actuates a switch S10 which closes a circuit to indicate that cylinder 424 is in the down position.

When an extend rammer solenoid L6 (FIG. 16) is energized shifting the core of solenoid valve 438 to the right pressurized fluid from source P is coupled through valve 438 to the right end of cylinder 424 causing a piston P13 to move to the left and to extend ram rod 66 against the cartridge R. Optical switch S21 (FIGS. 15, 16) verifies the position of cartridge R when the load tray 43 (FIGS. 3, 15) is in the up position. Optical switches S12 and S22 provide signals to indicate that an ejected case or a misfired cartridge has cleared the tube 420. Optical switch S12 also provides a signal to indicate that inner tray 80 is fully extended.

At the start of a load cycle, the inner eject tray 80 is retracted and the ram cylinder 424 is in the up position. After the load tray support 42 is aligned with the gun breech, the cartridge clamps are opened and the ram cylinder 424 is lowered. The rammer 66 (FIG. 5) is then extended against the cartridge R causing the cartridge to obtain a speed which will allow it to coast into the gun chamber. The flange R1 of the cartridge R pushes the extractors forward allowing the breech to close. After the breech block is closed the rammer 66 is retracted and the cylinder 426 is retracted causing the ram cylinder 424 to be raised to the upper position. When the gun returns to the horizontal position, after firing, the inner telescoping tube 80 is extended, the breech is opened and the empty cartridge case is ejected through the inner telescoping tube 80, fixed tube 420 and the reload door 78. A misfired cartridge is ejected in the same manner.

Figure 17:
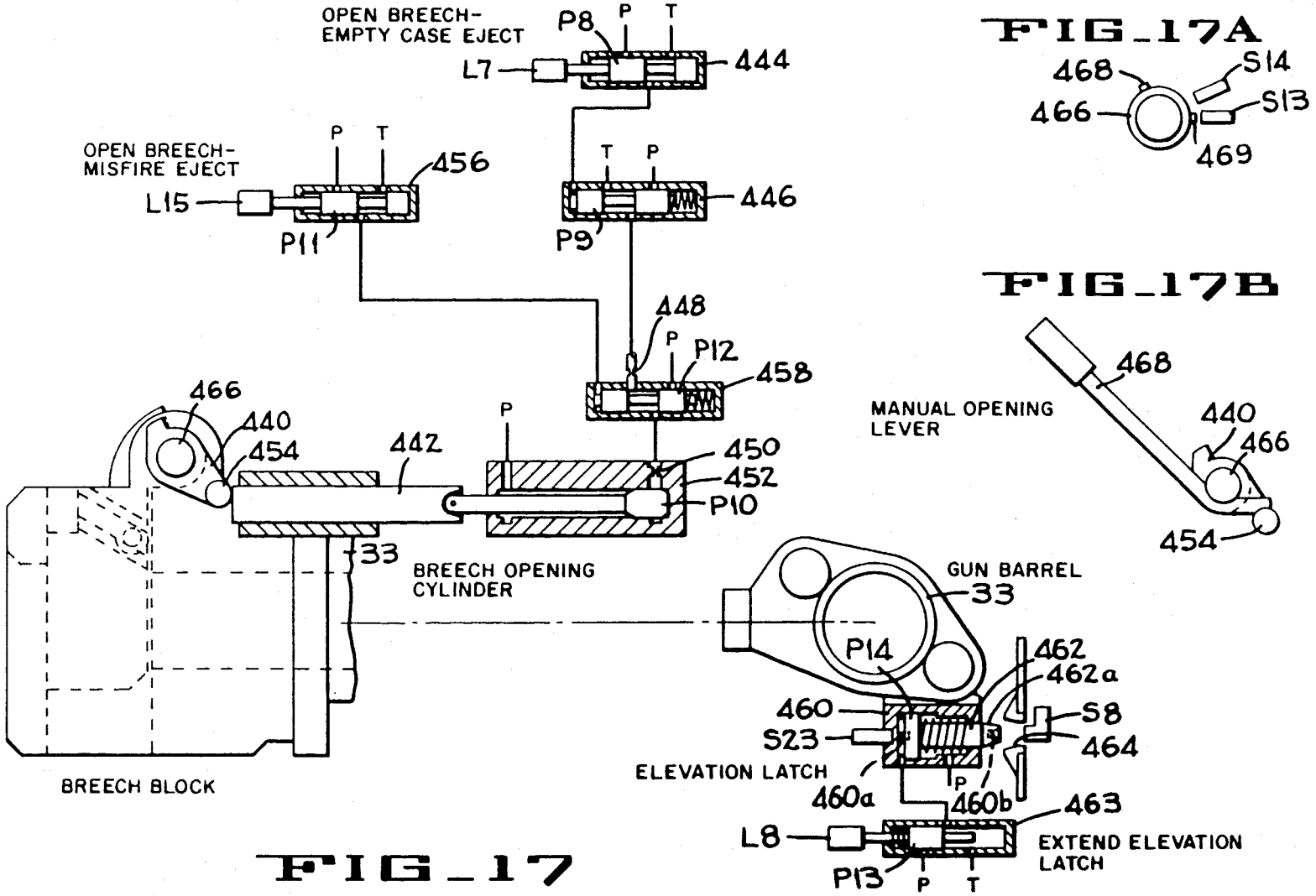
FIG. 17 is a schematic operational view of the several mechanical and hydraulic components of the breech opener and the gun elevation latch

A hydraulic circuit for an operating mechanism which opens and closes a standard gun breech and locks the gun in a horizontal position during loading and unloading the firing chamber of a gun is disclosed in FIGS. 6, 17. The gun includes a plurality of cam operated fingers (not shown) which remove a cartridge from the firing chamber in response to power from a plurality of hydraulically operated cylinders. The gun breech is opened by rotating an operating crank 440 (FIG. 17) in a clockwise direction in response to movement of a hydraulically operated pusher bar 442. The operating crank 440 is also coupled to the cam operated breech block which in turn is coupled to fingers which remove the cartridge from the gun. The fingers are operated with two different amounts of power. The lower power is used to eject an empty case which is light in weight, and the higher power is used to eject a misfired cartridge which weighs approximately six to eight times as much as an empty case. The operating cylinder piston P10 of cylinder 452 is biased to the right end by pressurized fluid from source P coupled directly to the retract port.

To open the breech and eject an empty case an open-breech empty-case eject solenoid L7 (FIG. 17) is energized moving a piston P8 in valve 444 to the right, coupling pressurized fluid from the source P to the left end of a valve 446 and moving a piston P9 to the right. Pressurized fluid flows from source P through valves 446, 458 and a pair of orifices 448, 450 to the right end of a cylinder 452 moving a piston P10 and pusher bar 442 to the left. The area of piston P10 at the right end is greater than the area of piston P10 at the left end so the piston is forced to the left when fluid from source P is applied to both ends of piston P10. Pusher bar 442 forces a roller 454 to the left and turns the crank 440 clockwise causing the gun breech block to be moved up and the cartridge to be ejected directly through the inner tray 80, the fixed tray 420 (FIG. 4) and out the hatch door 78.

To eject a misfired cartridge an open-breech misfire eject solenoid L15 (FIG. 17) is energized moving a piston P11 in valve 456 to the left and coupling pressurized fluid from source P to the left end of a valve 458 and moving piston P12 to the right thereby causing fluid to flow through orifice 450 to the right end of cylinder 452 moving piston P10 and pusher bar 442 to the left. Since pressurized fluid for moving piston P10 bypasses the orifice 448 a larger amount of power is available to move the cartridge than when fluid flows through both orifices 448 and 450. The unfired cartridge is ejected out the hatch door 78 as described above, and at approximately the same velocity as an empty case is ejected.

To unload an unfired cartridge and return the unfired cartridge to the magazine, hydraulic fluid is ported through both orifices 448 and 450 (FIG. 17), the same as for an empty case. This causes the cartridge to be moved at a lower velocity and the cartridge is stopped on the load tray 43 (FIGS. 3, 15) by the restraint lever 374 and the dashpot in cylinder 380. The load tray support 42 (FIG. 2) is lowered and the load tray translate drive moves the cartridge into the magazine 44.

The operating crank 440 (FIG. 17) is secured to a rotatable shaft 466 having a pair of magnets 468, 469 (FIG. 17A) mounted on the shaft. When the breech block is closed the magnet 469 actuates a magnetic switch S13 to provide a "breech block closed" signal, and when the breech block is open the magnet 468 actuates a magnetic switch S14 to provide a "breech block open" signal. A removable handle 468 can be positioned as shown in FIG. 17B and moved clockwise to open the breech block in the event of a loss of hydraulic power.

The gun must always be loaded and unloaded with the gun barrel 33 (FIG. 17) in a horizontal position, so an elevation latch 460 is included to provide a method to secure it in that position. Sensors S23 and S8 are included to provide a signal to indicate the elevation latch is disengaged or engaged, respectively. Magnet 460a in the piston P14 actuates switch S23 when the latch 460 is retracted and magnet 460*b* in the rod 462 actuates switch S8 when the latch 460 is extended. The piston P14 of latch 460 is biased to the left side (FIG. 17) by pressurized fluid from source P coupled directly to the retract port. The elevation latch 460 includes a piston P14 and a rod 462 having a tapered end portion 462*a*. The gun barrel 33 is moved into the horizontal position and a solenoid L8 is energized moving a piston P13 in valve 463 to the left and coupling pressurized fluid from source P to the left end of the latch cylinder 460. Piston P14 and rod 462 are moved to the right causing the tapered portion 462*a* to move into a notch 464 in the turret thereby locking the gun in the horizontal position and actuating a switch S8 which closes a circuit to indicate the gun is latched.

RELOAD-EJECT HATCH ASSEMBLY

The reload-eject hatch assembly 480 is best shown in FIGS. 2, 6 and 18–20.

Having reference to FIG. 19, the door or hatch 78 of the reload-eject hatch assembly 480 is shown in position to close the reload-eject port 481 in the rear wall 483 of the turret 31 (FIG. 6) in alignment with the rammer and empty tray case eject tray 420. The reload-eject hatch assembly 480 is also shown closed in FIG. 2.

The reload-eject hatch assembly 480 (FIGS. 18–20) includes a spindle 482 which is rotatably received in an open ended housing 484. The housing includes a large diameter portion which extends through a hole 486 in the rear wall of the turret 31 and is bolted thereto. The spindle has a large diameter door mounting end portion 488 which extends through a first end of the housing 484 and through the hole 486 in the rear wall of the turret 31. The door 78 is bolted to the large diameter end portion of the spindle 482 while the other end portion 489 of the spindle is splined. A crank arm 490 is mounted on the splined portion 489 for rotation therewith but for axial sliding movement relative thereto. A cap 492 with an arcuate slot 494 (FIG. 20) therein through which the crank arm 490 projects is bolted to the other end of the housing to maintain the crank arm in a predetermined linkage plane. A cam groove 495 in the spindle 482 bears against a roller 496 and is journaled in a connector 498 secured to the housing 484. The cam groove 495 is shaped to cause the hatch to move a small distance (about a quarter of an inch) away from the turret face adjacent the reload-eject port 481 therein during the initial rotation of the hatch or door 78 from the closed position toward the open position. This feature provides clearance for irregularities in the turret surface as well as clearance for an optional seal 502 recessed in a groove 504 in the hatch 78.

A hatch opening mechanism 506 is positioned within the turret 31 and is best shown in FIG. 20. The mechanism 506 includes a hydraulic cylinder 508 having a piston rod 510 therein which is pivotally connected to a first arm of a bell crank 512 by a link 514. The bell crank is pivotally supported on bracket 515 (FIG. 18) by a pivot bolt 516. The bracket 515 is bolted to the inside surface of the cap 492. A second arm 518 of the bell crank is pivotally connected to the crank arm 490 by a link 520 and a third arm of a bell crank 512 is pivotally connected to a plunger 522 that is slidably received in a hole in the bracket 515. A return spring 526 on the plunger 522 applies a force which tends to pivot the bell crank in a clockwise direction (FIGS. 18 and 20). When the hatch 78 is closed as illustrated in FIG. 20, the longitudinal axis of the second arm 518 of the bell crank and the link 520 are aligned thereby locking the hatch 78 closed by force from the spring 526 when the hydraulic power is off. A magnet 527 on the crank arm 490 energizes a magnetic switch 516 when the door 78 is open.

A solenoid operated valve 528 which is shown de-energized in FIG. 20 is connected to tank T and a source of high pressure hydraulic fluid at P. High pressure fluid bypasses the solenoid valve 528 and flows directly into the rod end of the cylinder 508 thereby normally locking the hatch door 78 closed. When the hatch door is to be opened, the solenoid L9 is energized thereby shifting the core of the valve 528 to a position which prevents flow to tank T and which allows flow of high pressure fluid through solenoid valve 528 into the case end of the cylinder. This fluid then flows through a fixed orifice 530 and thus pivots bell crank 518 in a counterclockwise direction and the hatch 78 in a clockwise direction (FIG. 20) thereby opening the door while compressing the spring 526. The orifice 530 is provided to control the rate of movement of the hatch when being opened and closed. When the solenoid L9 is energized, it will be noted that the conduit to tank T is closed and that hydraulic fluid at equal pressure is directed into the case and rod ends of the cylinder 508. It will be noted that the effective area of the case end of the piston is the cross sectional area of the cylinder, while the effective area of the rod end of the cylinder is reduced by the cross sectional area of the rod. Thus the rod will move downwardly (FIG. 20) forcing an amount of fluid displaced from the lower end of the cylinder 508 through the open solenoid valve 528 and back into the case end of the cylinder 508. Thus, no fluid returns to tank T at this time. The hatch 78 is first freely pivoted toward the closed position and is then moved axially by the cam groove 495 and roller 496 into snug engagement over the discharge port 481 in the turret wall. If the seal 502 is used, the hatch 78 provides a fluid tight seal when closed. It will also be understood that the gases resulting from firing the gun, as well as the empty cases which are quite hot after firing, are expelled from the turret and vehicle through the open hatch 78. It will further be appreciated that the armored partition 102 in the turret 31 prevents the hot gases from entering the gunner's and commander's area 101 of the turret 34. The partition 102 also greatly reduces the noise level in the operator's area of the turret when the gun is fired.

Figure 21A:
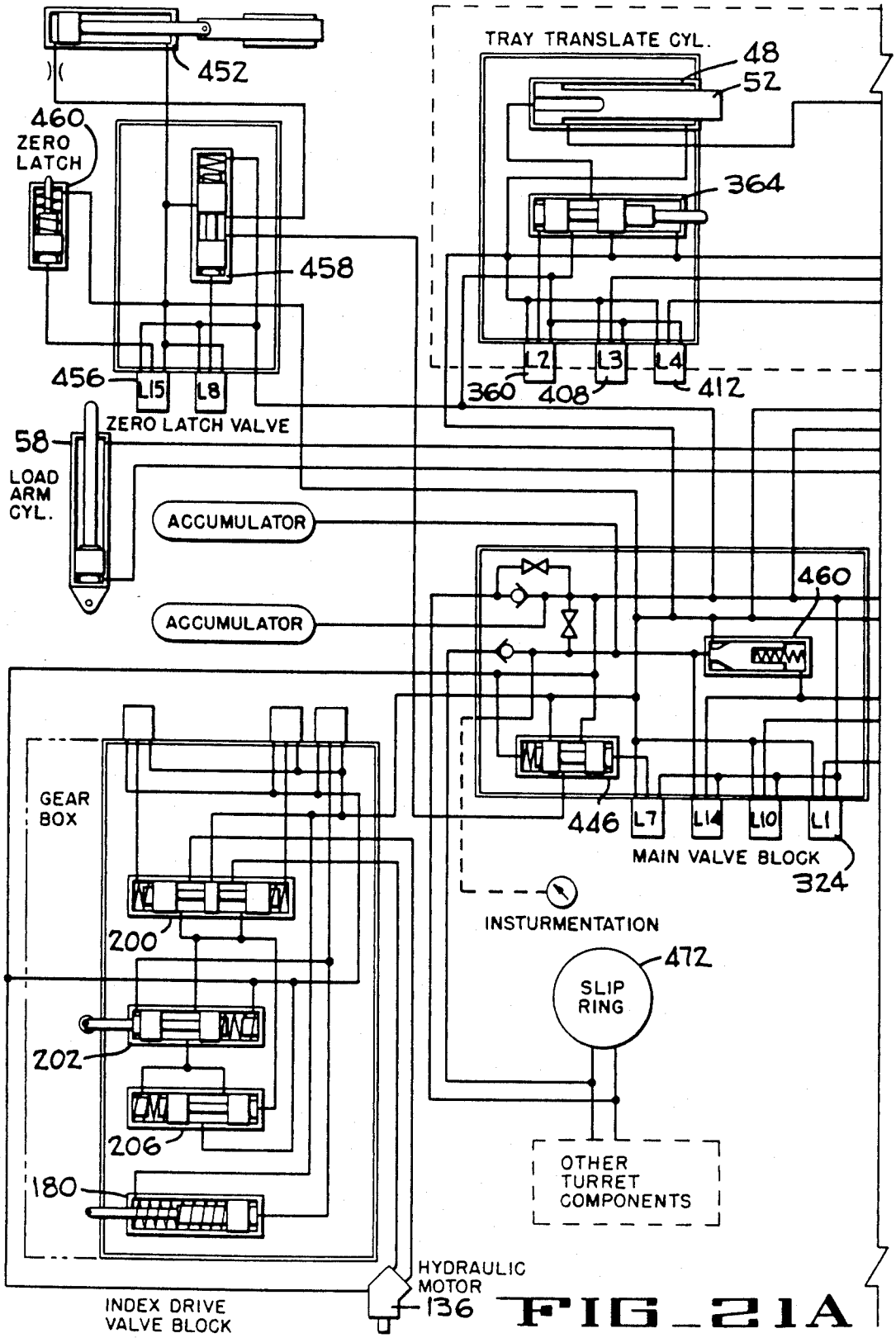
Figure 21B:
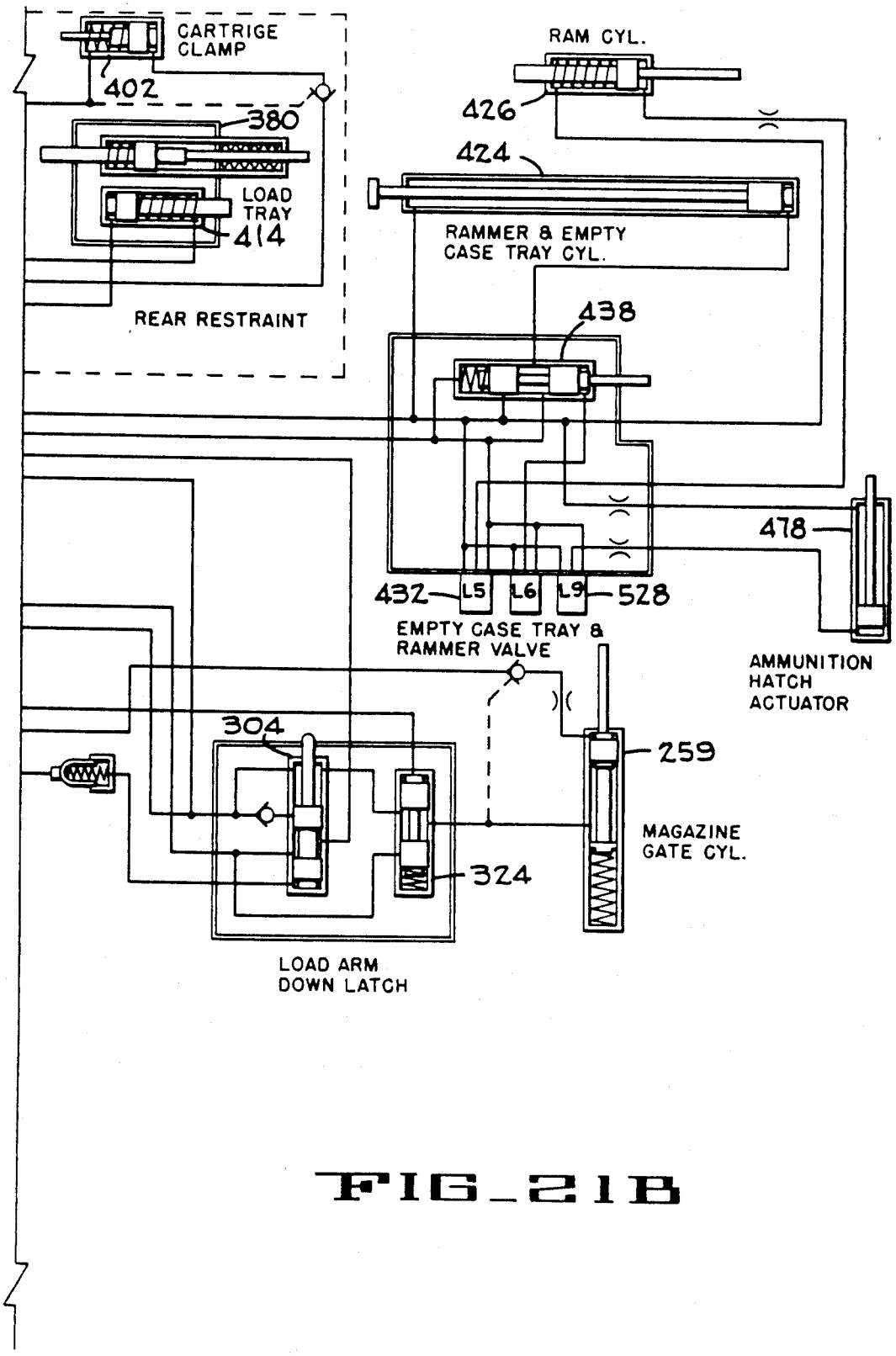

The several hydraulic circuits for the different mechanical components of the autoloader of the present invention have already been described. It is believed, however, that it would be helpful to illustrate the hydraulic circuits of all these mechanical components in the single circuit illustrated in FIGS. 21A and 21B. Since the individual circuits and their function have already been described, only the reference numerals of the hydraulics and certain electrical components will be given. It is noted, however, that the circuits into the turret 31 pass through a conventional slip ring 538. A conventional engine which drives the vehicle and a hydraulic pump (not shown) are located in the vehicle 32 externally of the turret 31.

Figure 22:
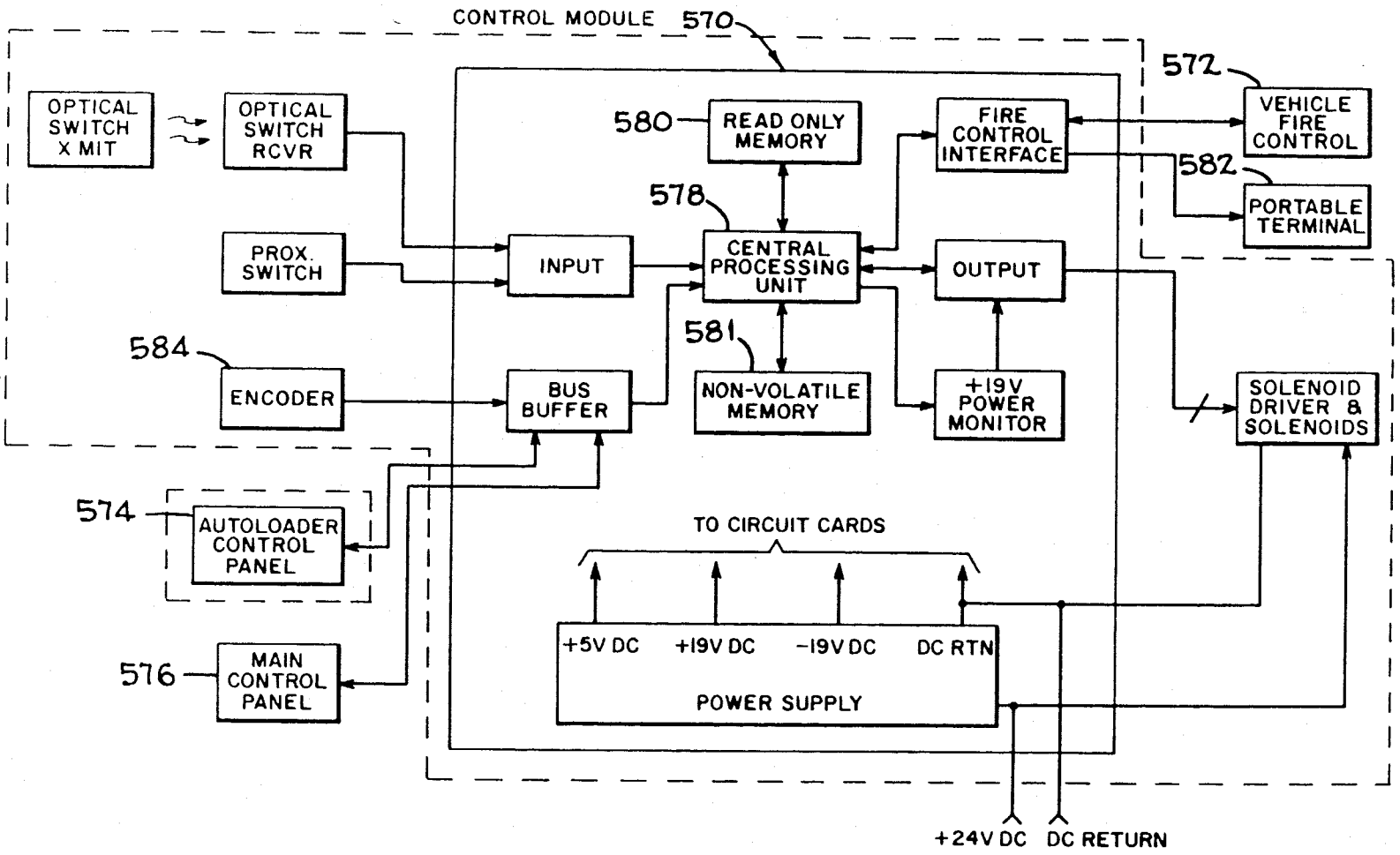
FIG. 22 is a block diagram of the circuit for controlling the operation of the autoloader

An autoloader control module 570 (FIG. 22) controls the sequence of operation of the autoloader in response to signals from a vehicle fire control system 572 and to signals from a pair of control panels 574, 576. The module 570 also keeps an inventory of the ammunition in the autoloader and continuously monitors the performance of the autoloader. A central processing unit 578 and a pair of memories 580, 581 cause the autoloader to load a round into the gun breech, unload a round from the breech, off-load a round from the magazine, replenish the magazine, eject a misfired round and execute a test of the autoloader system.

The autoloader module 570 (FIG. 22) receives gun elevation signals from the fire control system 572 and module 570 provides autoloader status, breech status, gun status and inventory data. The main control panel 576 provides round type, clear, load and autoloader operation signals to module 570. The control panel 576 receives selected round count, total round count, type of round in breech and breech clear signals from the control module 570. A portable terminal 582 can be selectively connected to module 570 and used to check operation of the control module 570 and associated equipment.

The autoloader control panel 574 (FIG. 22) can supply operator actuated inputs such as eject misfire operation, off-load, replenish, test autoloader system, simulate mode enabled and autoloader hydraulic pressure enable signals. Panel 574 displays signals which indicate an autoloader non-critical failure, autoloader critical failure, a cycle started and a cycle ended. An encoder 584 provides signals which indicate the position of various rounds relative to the unload station of the autoloader.

The control module 570 provides on-line testing of mechanical portions, electronic portions and system sensors. System operation, built-in test are checked and faults are isolated to facilitate quick repairs.

Figure 23:
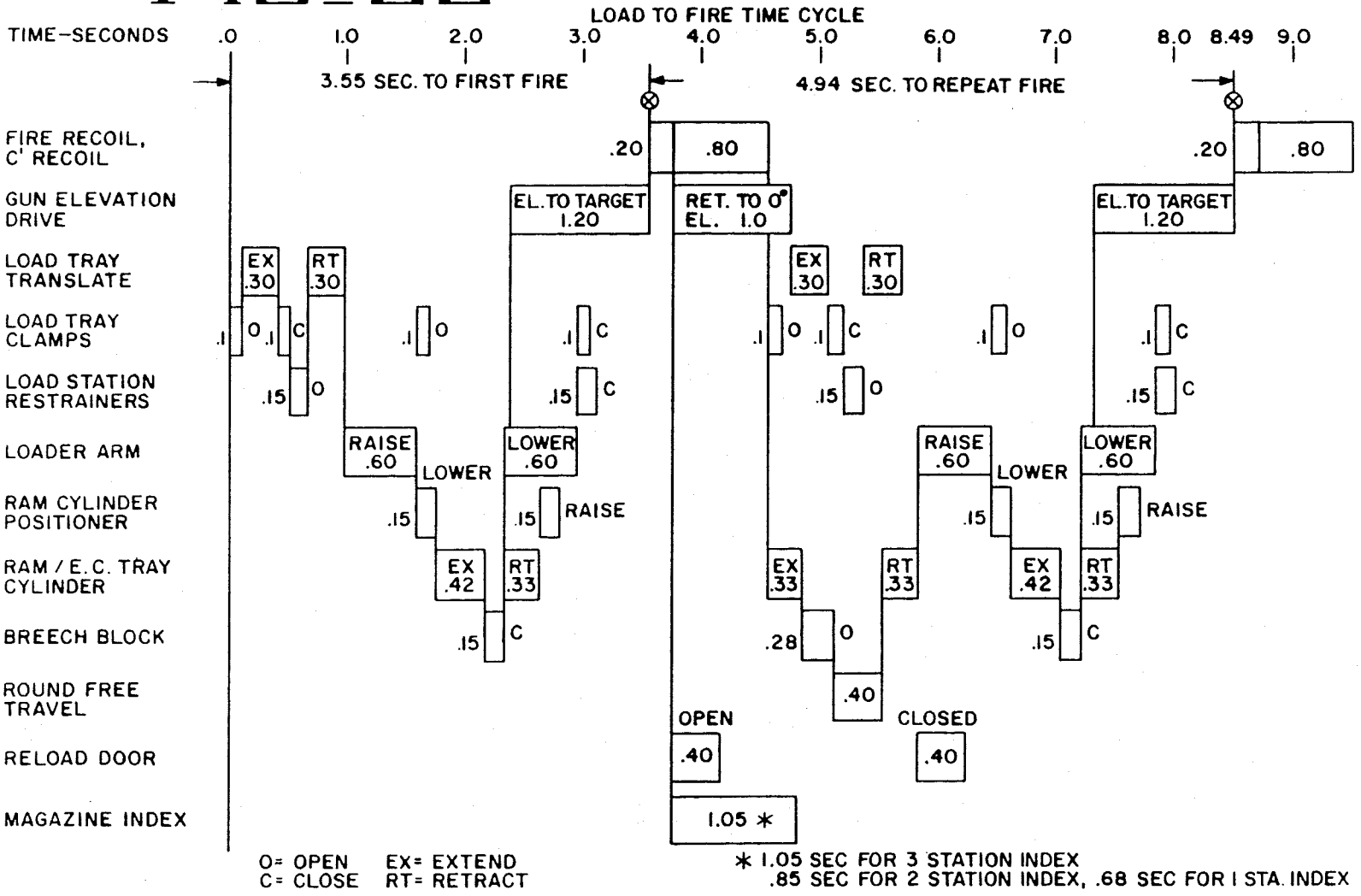
FIG. 23 is a timing diagram illustrating the timing of the several functions performed when loading the gun.
Figure 24:
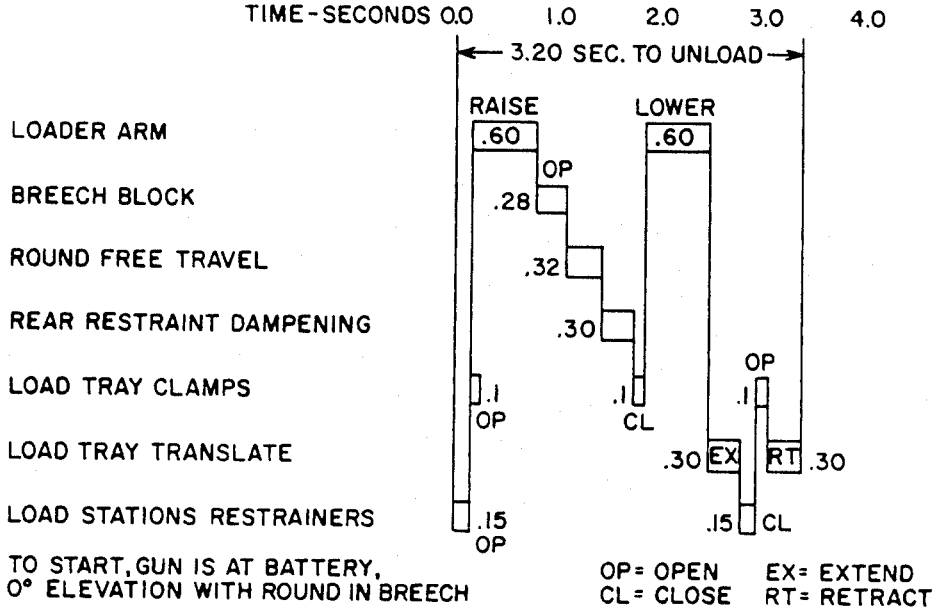
FIG. 24 is a timing diagram illustrating the timing of the several functions when unloading a round from the gun and returning it to the magazine.
Figure 25:
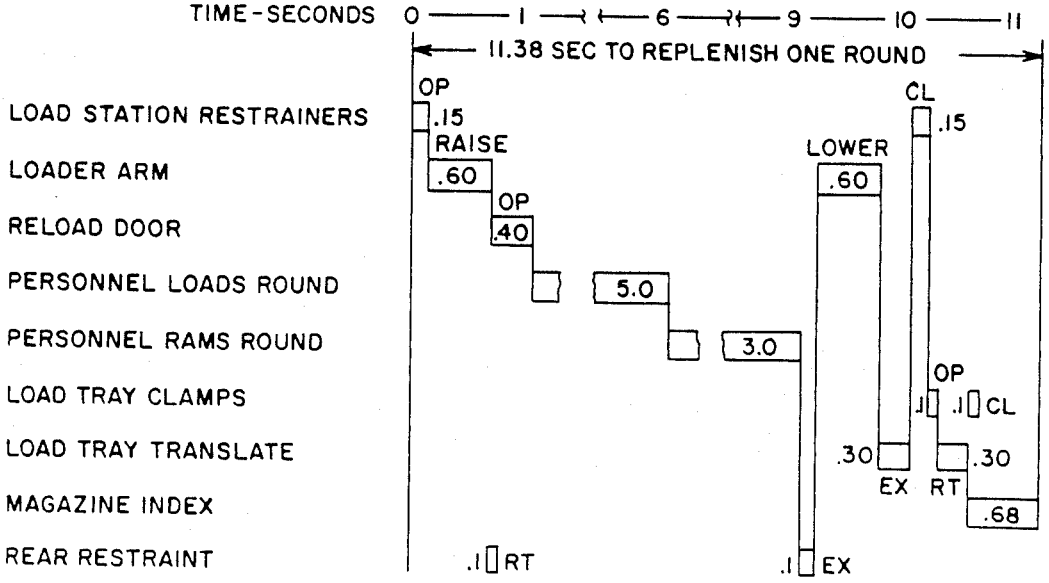
FIG. 25 is a timing diagram illustrating the timing of the several functions performed when replenishing cartridges into the magazine conveyor

A timing diagram which discloses the sequence and time duration of the various portions of the loading, firing, recoil and reloading cycles is shown in FIG. 23. Typical times in sequence of unloading an unfired round from the gun back into the magazine are shown in FIG. 24. Typical times and sequence of loading the magazine are shown in FIG. 25. During the magazine loading times of FIG. 25 cartridges from outside the vehicle are manually loaded through the ejection/-reload port and the cartridges placed in appropriate locations in the magazine by the autoloader for later use.

Although the best mode contemplated for carrying out the present invention has been herein shown and described, it will be apparent that modification and variation may be made without department from what is regarded to be the subject matter of the invention.

What is claimed is:

1. An autoloading apparatus for loading and unloading cartridges having cases into or out of a gun having a breach block and mounted for pivotal movement about a substantial horizontal axis, comprising:

locking means for selectively locking the gun in a predetermined position and unlocking the gun for pivotal movement about said horizontal axis;

magazine conveying means for supporting a plurality of cartridges and having a load-unload station;

load tray means mounted for pivotal movement between a substantially vertical position and a substantially horizontal position in alignment with the gun when locked;

cartridge clamp means on said tray for movement between a cartridge clamping position and an open cartridge guiding position;

rammer and extensible empty tray case ejecting means for ramming a cartridge on said load tray means into said gun and after firing to eject the empty cartridge case from said autoloading apparatus;

power means for operating said gun locking means, said magazine conveyor, said load tray means, said cartridge clamping means and said rammer and extensible tray case and eject means;

automated control means for sequentially locking the gun in said predetermined position, driving said magazine to position a selected cartridge at said load-unload station, translating said load tray into said load-unload station, moving the clamp means into gripping engagement with said selected cartridge, moving the tray and selected cartridge into alignment with the gun, moving the rammer for ramming the cartridge into the gun to be fired, closing the breach block, and unloading said locking means for releasing the gun to be aimed and fired;

a rotatable turret mounted for rotation about a vertical axis; the gun and autoloader apparatus being supported by said turret, means defining a cartridge reload-eject port in said turret, means defining a reload hatch door movably mounted on said turret for opening and closing said reload-eject port, said load tray means including a rear restraint damper, a magazine housing having said magazine conveyor means therein and having a load-unload port therein, a magazine gate assembly having restraining arms movable between a closed and an open position in said load-unload port:

wherein when a cartridge is to be loaded into the magazine conveyor from externally of said turret;

said automatic control means sequentially opening said restraining arms, raising said load tray means into said substantially horizontal position in alignment with said gun, opening said reload hatch doors, and retracting said rear restraint damper;

after one of said cartridges is manually inserted through said reload-eject port and is manually rammed onto said load tray means;

said automatic control means sequentially extending said rear restraint dampener, lowering said load tray means, translating said load tray means into said magazine load-unload port, closing said load station restraining arms, opening said load tray cartridge clamps, translating said load tray means out of said load-unload port, and closing said cartridge clamp means while indexing said magazine conveyor and the cartridge away from said load-unload station.

2. An autoloading method for selectively transferring cartridges having cases between a magazine and a gun having a breech and a breech block with the magazine and the gun being supported by a turret for rotation therewith about a substantially vertical axis with the gun being movable relative to the turret between a substantially horizontal 0° position and an upwardly inclined position; said turret having auto loading components therein including a cartridge carrying magazine conveyor in said magazine and adapted to be indexed with a magazine load-unload port having load station restraining arms therein, gun locking means, a load tray movable between a 0° position in alignment with the gun and a vertical position with cartridge clamps and a rear restraint damper thereon, a rammer and telescopic empty case eject means, a reload hatch door for selectively closing a reload eject port in the turret, power means for selectively operating the above components, and automated control means for controlling said components;

when replenishing cartridges from externally of said turret into said magazine when the gun is locked in said 0° position with the breech block open, said method comprising the steps of:

said automated controller means first opening said load station restraining arms;

raising said load tray to said substantially horizontal 0° position;

opening said reload hatch door;

retracting said rear restraint damper on said load tray;

holding said automatic controller means inactive until a cartridge is manually inserted through said reload hatch door and is manually rammed onto said load tray means;

extending said rear restraint damper of said load tray into position to be engaged by the cartridge;

lowering said load tray to said vertical position;

translating said load tray and cartridge into said magazine through said load-unload port for support by said magazine conveyor;

closing said load station restraining arms to restrain the cartridge within said magazine;

opening said load tray cartridge clamps;

translating said empty load tray out of said magazine load-unload port; and indexing said magazine conveyor to a position for receiving another round.

3. A method according to claim 2 wherein about 13.5 seconds is required to replenish one cartridge.

4. A method according to claim 2 wherein about 3 minutes and 40 seconds is required to load 19 cartridges into the magazine.

5. A method according to claim 2 wherein said turret is divided into two compartments with the breach of the gun and the majority of the mechanical portions of the autoloader being in one compartment, and at least one operator being in the other compartment; and additionally comprising the step of sealing said other compartment in substantially airtight engagement relative to said one compartment and with the atmosphere externally of the turret for protection against chemical warfare.

* * * * *